US009784271B2

(12) United States Patent
Jin et al.

(10) Patent No.: US 9,784,271 B2
(45) Date of Patent: Oct. 10, 2017

(54) SCROLL COMPRESSOR

(71) Applicant: LG ELECTRONICS INC., Seoul (KR)

(72) Inventors: Honggyun Jin, Seoul (KR); Munyoung Lee, Seoul (KR); Nara Han, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 303 days.

(21) Appl. No.: 14/703,159

(22) Filed: May 4, 2015

(65) Prior Publication Data

US 2015/0316058 A1 Nov. 5, 2015

(30) Foreign Application Priority Data

May 2, 2014 (KR) ..... 10-2014-0053482

(51) Int. Cl.
*F04C 18/04* (2006.01)
*F04C 18/02* (2006.01)
(Continued)

(52) U.S. Cl.
CPC ..... *F04C 18/0215* (2013.01); *F04C 27/005* (2013.01); *F04C 27/008* (2013.01);
(Continued)

(58) Field of Classification Search
CPC ... F04C 27/005; F04C 15/0003; F04C 27/009
(Continued)

(56) References Cited

U.S. PATENT DOCUMENTS 4,179,131 A 12/1979 Nussbaumer
6,146,119 A * 11/2000 Bush ..... F04C 27/005 418/55.4

(Continued)

FOREIGN PATENT DOCUMENTS

| | | |
|---|---|---|
| CN | 1060699 | 4/1992 |
| CN | 1177062 | 3/1998 |
| EP | 1593850 | 11/2005 |
| JP | H02248675 | 10/1990 |
| KR | 10-2001-0049691 A | 6/2001 |

OTHER PUBLICATIONS

Chinese Office Action dated Nov. 4, 2016 issued in Application No. 201510222226.0 with English Translation.

*Primary Examiner* — Mark Laurenzi
*Assistant Examiner* — Anthony Ayala Delgado
(74) *Attorney, Agent, or Firm* — Ked & Associates, LLP

(57) ABSTRACT

A scroll compressor is provided that may include a first scroll, a second scroll that defines a plurality of compression chambers together with the first scroll, the second scroll having a discharge hole that communicates with a compression chamber among the plurality of compression chambers, a back pressure plate that defines a back pressure chamber to accommodate a refrigerant discharged from the discharge hole, a floating plate to define the back pressure chamber, and a sealing member to prevent the refrigerant from flowing between a first surface, which may be a sliding surface of the floating plate, and a second surface, which may face the first surface, of the back pressure plate. The sealing member may include a seal cover that contacts the other one of the first and second surfaces, and a seal, a portion of which may be accommodated in the seal cover. The seal cover may have a friction coefficient less than a friction coefficient of the seal.

20 Claims, 23 Drawing Sheets

(51) Int. Cl.

| | |
|---|---|
| ***F04C 27/00*** | (2006.01) |
| ***F04C 28/26*** | (2006.01) |
| ***F04C 29/02*** | (2006.01) |
| ***F04C 29/12*** | (2006.01) |
| *F04C 23/00* | (2006.01) |

(52) U.S. Cl.
CPC ..... *F04C 28/26* (2013.01); *F04C 29/02* (2013.01); *F04C 29/122* (2013.01); *F04C 23/008* (2013.01); *F05C 2225/04* (2013.01); *F05C 2251/14* (2013.01); *F05C 2253/04* (2013.01)

(58) Field of Classification Search
USPC ..... 418/55.4, 55.1, 57, 270
See application file for complete search history.

(56) References Cited

U.S. PATENT DOCUMENTS

| | | | | |
|---|---|---|---|---|
| 6,457,948 | B1 * | 10/2002 | Pham | F04C 23/008 417/212 |
| 6,679,683 | B2 * | 1/2004 | Seibel | F04C 18/0215 417/213 |
| 6,695,599 | B2 * | 2/2004 | Uchida | F04C 27/005 418/55.4 |
| 7,338,265 | B2 * | 3/2008 | Grassbaugh | F04C 18/0215 418/270 |
| 7,837,452 | B2 * | 11/2010 | Ignatiev | F04C 18/0215 418/55.2 |
| 8,932,036 | B2 * | 1/2015 | Monnier | F04C 18/0215 418/1 |

* cited by examiner

RELATED ART

SCROLL COMPRESSOR

CROSS-REFERENCE TO RELATED APPLICATION(S)

The present application claims priority under 35 U.S.C. 119 and 35 U.S.C. 365 to Korean Patent Application No. 10-2014-0053482, filed in Korea on May 2, 2014, which is hereby incorporated by reference in its entirety.

BACKGROUND

1. Field

A scroll compressor is disclosed herein.

2. Background

A scroll compressor is a compressor that includes a fixed scroll having a spiral wrap, and an orbiting scroll that revolves with respect to the fixed scroll, that is, a compressor in which the fixed scroll and the orbiting scroll are engaged with each other. The orbiting scroll revolves with respect to the fixed scroll, thereby reducing a volume of a compression chamber, which is formed between the fixed scroll and the orbiting scroll according to an orbiting motion of an orbiting scroll, thus increasing a pressure of a fluid, which is then discharged through a discharge hole formed in a central portion of the fixed scroll.

In the scroll compressor, suction, compression, and discharge of a fluid are successively performed while the orbiting scroll revolves. Accordingly, a discharge valve and a suction valve may be unnecessary in principle. Also, as a number of components of the scroll compressor is less in comparison to other types of compressors, the scroll compressor may be simplified in structure and rotate at a high speed. Also, as a variation in torque required for compression is less, and suction and compression successively occur, a relatively small amount of noise and vibration may occur.

One of important issue in the scroll compressor is leakage and lubrication between the fixed scroll and the orbiting scroll. That is, to prevent a refrigerant from leaking between the fixed scroll and the orbiting scroll, an end of the wrap has to be closely attached to a surface of a head plate to prevent the compressed refrigerant from leaking. The head plate may refer to a portion that corresponds to a main body of the fixed scroll or the orbiting scroll. That is, the head plate of the fixed scroll may be closely attached to a wrap of the orbiting scroll, and the head plate of the orbiting scroll may be closely attached to a wrap of the fixed scroll.

On the other hand, friction resistance has to be minimized so as to allow the orbiting scroll to smoothly revolve with respect to the fixed scroll. However, leakage may conflict with lubrication. That is, when the end of the wrap and the surface of the head plate are strongly attached to each other, it may be advantageous with respect to the leakage, but friction may increase, increasing damage due to noise and abrasion. On the other hand, an adhesion force is lowered, the friction may be reduced, but a sealing force may decrease, increasing the fluid leakage.

Thus, according to the related art, a back pressure chamber having an intermediate pressure, which is defined as a value between a discharge pressure and a suction pressure, may be formed in a back surface of the orbiting scroll or the fixed scroll to solve limitations with respect to sealing and friction reduction. That is, the back pressure chamber that communicates with a compression chamber having an intermediate pressure of a plurality of compression chambers formed between the orbiting scroll and the fixed scroll may be formed to allow the orbiting scroll and the fixed scroll to be adequately attached to each other, thereby solving the limitations with respect to the leakage and lubrication.

The back pressure chamber may be formed on a bottom surface of the orbiting scroll or a top surface of the fixed scroll. For convenience of description, the back pressure chamber formed on the bottom surface of the orbiting scroll and the back pressure chamber formed on the top surface of the fixed scroll are referred to as a lower back pressure type scroll compressor and an upper back pressure type scroll compressor, respectively. The lower back pressure type scroll compressor has advantages in that the lower back pressure type scroll compressor has a simple structure, and a bypass hole is easily formed. However, as the back pressure chamber is formed on the bottom surface of the orbiting scroll that performs the orbiting motion, the back pressure chamber may change in configuration and position according to the orbiting motion. As a result, the orbiting scroll may be tilted, causing vibration and noise. In addition, an O-ring inserted to prevent the refrigerant from leaking may be quickly worn out. The upper back pressure type scroll compressor has a relatively complicated structure. However, as the back pressure chamber is fixed in configuration and position, the fixed scroll may not be tilted, and sealing of the back pressure chamber may be good.

A method for processing a bearing housing and a scroll compressor including the bearing housing are disclosed in Korean Patent Publication No. 10-2001-0049691 (hereinafter, referred to as a "prior document"), published on Jun. 15, 2001, which is hereby incorporated by reference. An example of the upper back pressure type scroll compressor is disclosed in the prior document.

The scroll compressor according to the prior document includes an orbiting scroll disposed to revolve on a main frame fixedly installed inside of a casing and a fixed scroll engaged with the orbiting scroll. A back pressure chamber is defined on the fixing scroll, and a floating plate to seal the back pressure chamber is disposed to be vertically slid along an outer circumference of a discharge passage. A cover is disposed on a top surface of the floating plate to partition an inner space of the compressor into a suction space and a discharge space.

The back pressure chamber communicates with one of the compression chambers formed between the orbiting scroll and the fixed scroll having an intermediate pressure between a suction pressure and a discharge pressure, and thus, an intermediate pressure is applied to the back pressure chamber. Also, a pressure may be applied upward to the floating plate and downward to the fixed scroll. When the floating plate ascends by the pressure of the back pressure chamber, an end of the floating plate may contact the discharge cover to seal the discharge space. Also, the fixed scroll may move downward and then be closely attached to the orbiting scroll.

However, in a case of the upper back pressure type scroll compressor, when operation of the scroll compressor stops, an intermediate pressure refrigerant of the back pressure chamber may not be easily discharged toward the compression chamber and a suction-side by an orbiting scroll wrap. In detail, when the operation of the scroll compressor stops, the pressure within the scroll compressor may converge into a predetermined pressure (an equilibrium pressure). The equilibrium pressure may be a pressure slightly higher than a suction-side pressure. That is, the refrigerant of the compression chamber and the discharge-side refrigerant may be discharged, and the inside of the compressor may converge to the equilibrium pressure. Then, when the compressor operates again, the compressor may operate while a difference between the equilibrium pressure and a pressure at each position occurs.

It may be necessary to maintain the equilibrium pressure while the refrigerant of the back pressure chamber is discharged to the suction-side. If the refrigerant of the back pressure chamber is not discharged, the fixed scroll may be compressed downward by the pressure of the back pressure chamber, and thus, be maintained in a state in which the fixed scroll is closely attached to the orbiting scroll. Also, if the refrigerant of the back pressure chamber is not discharged, the pressure of the back pressure chamber may be maintained at the equilibrium pressure. Accordingly, the floating plate may move upward to contact the discharge cover. As a result, the discharge passage for the discharge-side refrigerant may be blocked, preventing the discharge-side refrigerant from being discharged to the suction-side of the compressor, thereby further compressing the fixed scroll downward.

As described above, when the fixed scroll is pressed to maintain the state in which the fixed scroll is closely attached to the orbiting scroll at a pressure greater than a predetermined pressure, it may be difficult to quickly drive the scroll compressor again. As a result, to quickly drive the scroll compressor again, a high initial torque of the compressor may be required. When the initial torque increases, noise and abrasion may occur, reducing operation efficiency of the compressor.

As described above, the refrigerant of the back pressure chamber has to be discharged toward the compression chamber and the suction-side when the operation of the compressor stops. However, in the case of the upper back pressure type scroll compressor according to the related art, when the compressor operates and then stops, the revolving orbiting scroll wrap may be disposed at one position of the head plate of the fixed scroll. The orbiting scroll may stop in a state in which an end of the orbiting scroll blocks a point of the head plate that communicates with the back pressure chamber, that is, a discharge hole to discharge the intermediate pressure refrigerant into the back pressure chamber.

When the discharge hole is blocked by the wrap of the orbiting scroll, discharge of the refrigerant of the back pressure chamber into the compression chamber and the suction-side may be limited. As a result, quick re-operation of the compressor may be limited. In addition, even though the refrigerant of the back pressure chamber is smoothly discharged, if the floating plate does not smoothly move downward, an equilibrium pressure reaching time within the compressor may increase.

FIG. 1 illustrates a variation in pressure within a scroll compressor when the scroll compressor according to the related art operates or stops. In FIG. 1, dotted line $P_1$ is a pressure of the refrigerant discharged from the scroll compressor, solid line $P_2$ is an intermediate pressure of the refrigerant of the back pressure chamber, dotted line $P_3$ is a pressure of the discharge cover-side refrigerant, and solid line $P_4$ is a pressure of the suction-side refrigerant.

Referring to FIG. 1, the scroll compressor according to the related art may stop at a time $t_0$ after the scroll compressor operates. After the scroll compressor is stopped, the inside of the scroll compressor may converge to a predetermined pressure.

However, as the refrigerant of the back pressure chamber is not discharged to the compression chamber and the suction-side of the scroll compressor, maintenance of the inner pressure of the compressor to the equilibrium pressure may be limited. That is, the equilibration between the suction-side pressure $P_4$ and other pressures may be limited to cause a predetermined pressure difference $\Delta P$.

Also, after the scroll compressor is stopped, the scroll compressor may quickly re-operate even though the scroll compressor re-operates at a time $t_1$. That is, the pressure difference within the scroll compressor has to be quickly generated while the orbiting scroll revolves. However, the orbiting scroll may re-operate at a time $t_2$ after a predetermined time has elapsed.

BRIEF DESCRIPTION OF THE DRAWINGS

Embodiments will be described in detail with reference to the following drawings in which like reference numerals refer to like elements, and wherein.

DETAILED DESCRIPTION

Figure 1:
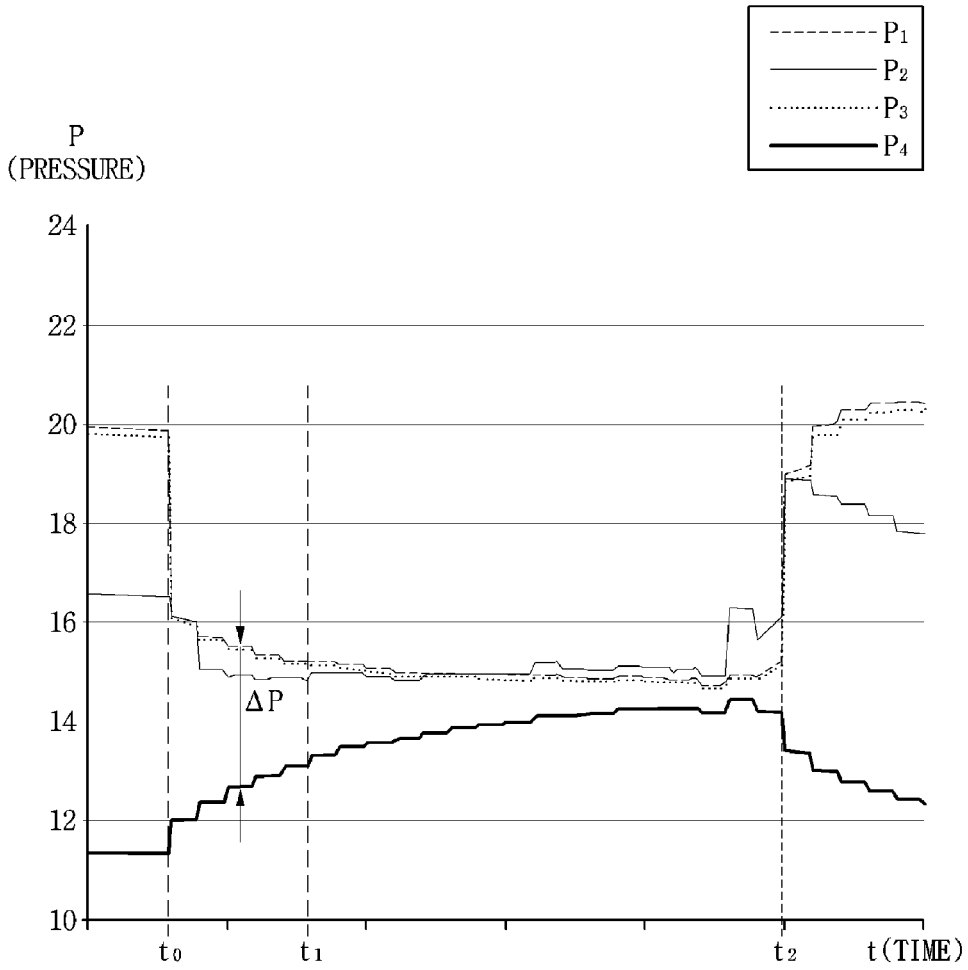
FIG. 1 illustrates a variation in pressure within a compressor when a scroll compressor according to a related art operates or stops.

Reference will now be made in detail to the embodiments, examples of which are illustrated in the accompanying drawings. Where possible, like reference numerals have been used to indicate like elements, and repetitive disclosure has been omitted.

In the following detailed description of embodiments, reference is made to the accompanying drawings that form a part hereof, and in which is shown by way of illustration specific embodiments which may be practiced. These embodiments are described in sufficient detail to enable those skilled in the art to practice the embodiments, and it is understood that other embodiments may be utilized and that logical structural, mechanical, electrical, and chemical changes may be made without departing from the spirit or scope. To avoid detail not necessary to enable those skilled in the art to practice the embodiments, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 2:
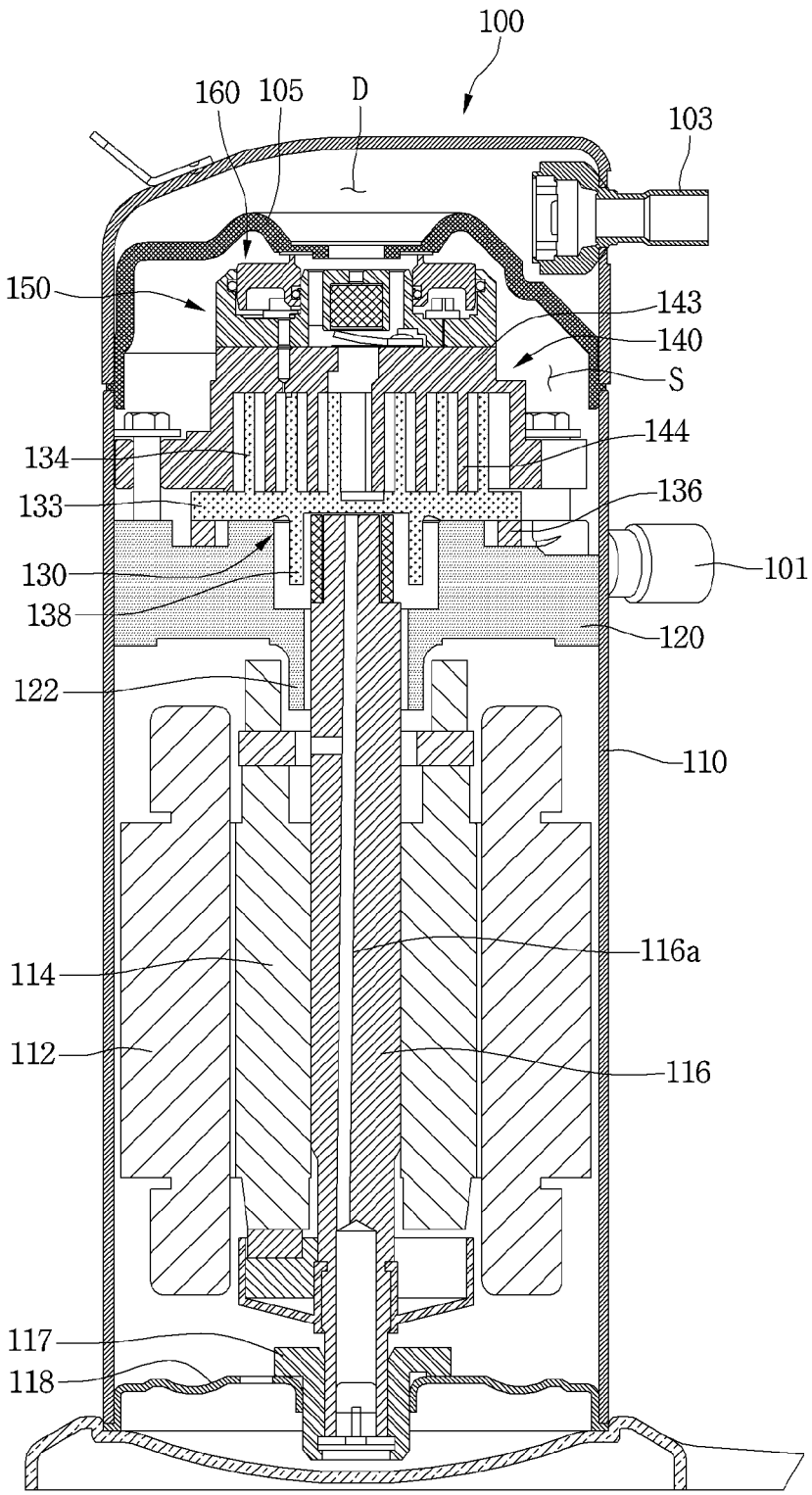
FIG. 2 is a cross-sectional view of a scroll compressor according to an embodiment.
Figure 3:
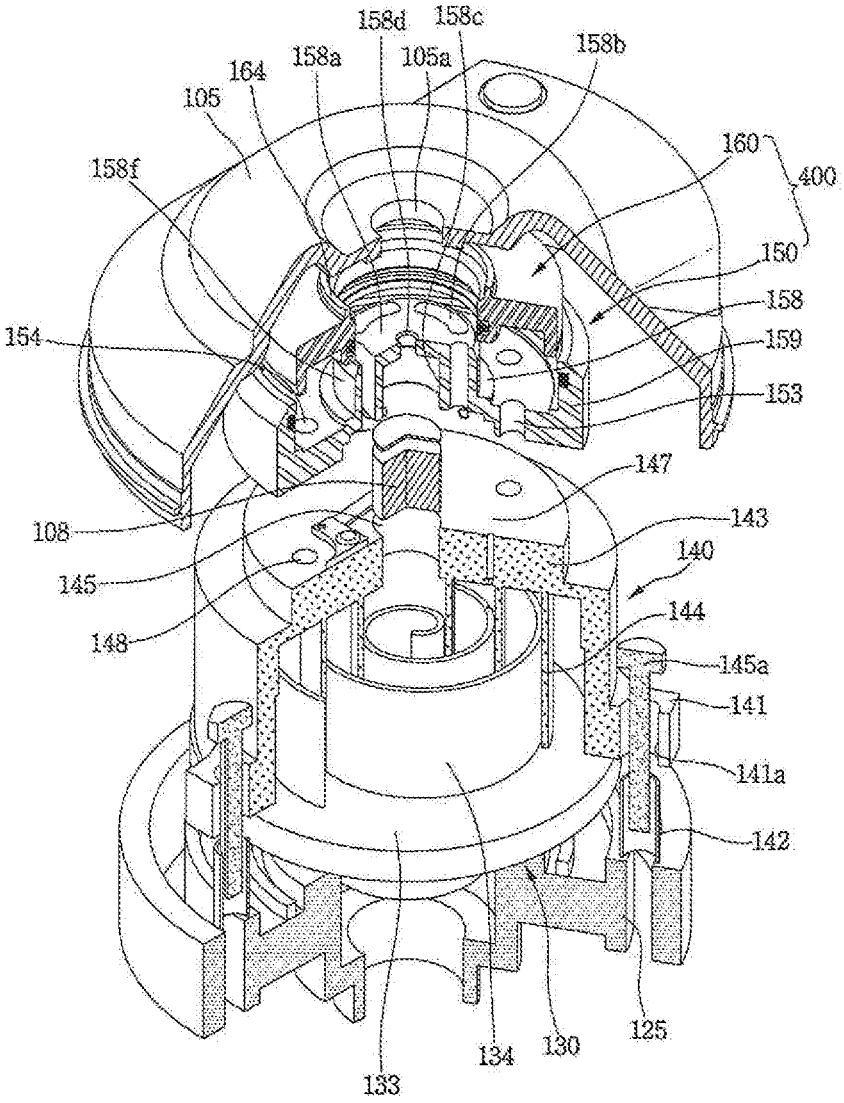
FIG. 3 is a partial exploded cross-sectional view of the scroll compressor of FIG. 2.
Figure 4:
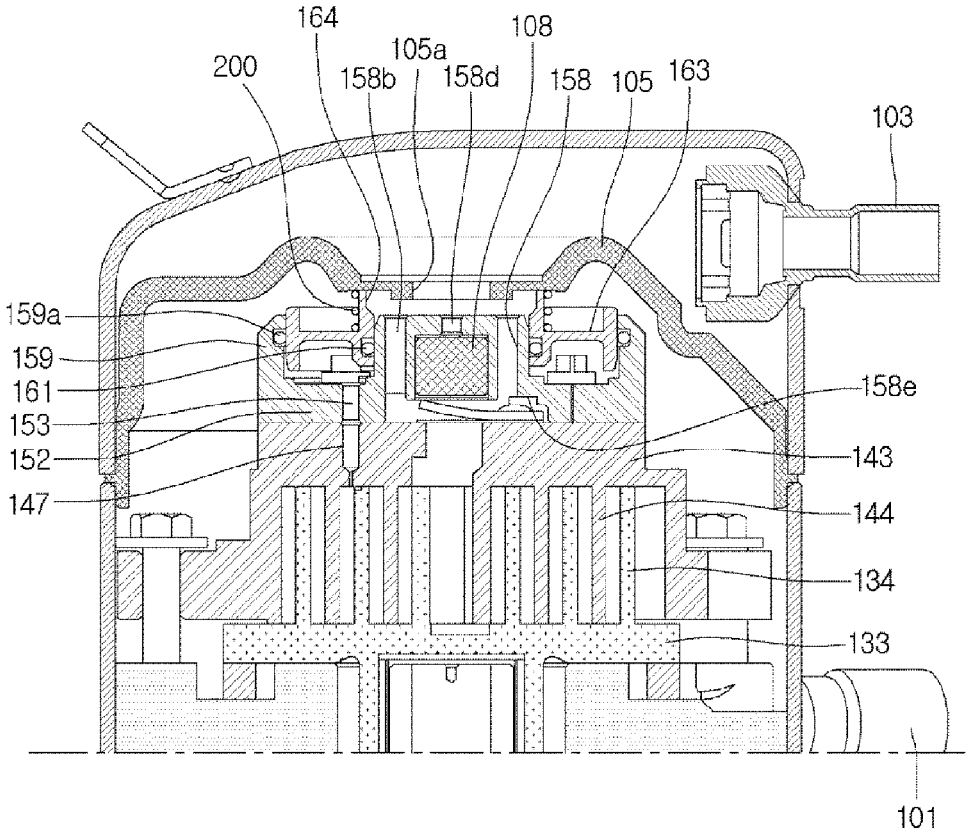
FIG. 4 is a partial cross-sectional view of the scroll compressor of FIG. 2.

FIG. 2 is a cross-sectional view of a scroll compressor according to an embodiment. FIG. 3 is a partial exploded cross-sectional view of the scroll compressor of FIG. 2. FIG. 4 is a partial cross-sectional view of the scroll compressor of FIG. 2.

Referring to FIGS. 2 to 4, a scroll compressor 100 according to an embodiment may include a casing 110 having a suction space S and a discharge space D. In detail, a discharge cover 105 may be disposed in or at an inner upper portion of the casing 110. An inner space of the casing 110 may be partitioned into the suction space S and the discharge space D by the discharge cover 105. An upper space of the discharge cover 105 may be the discharge space D, and a lower space of the discharge cover 105 may be the suction space S. A discharge hole 105*a*, through which a refrigerant compressed to a high pressure may be discharged, may be defined in an approximately central portion of the discharge cover 105.

The scroll compressor 100 may further include a suction port 101 that communicates with the suction space S, and a discharge port 103 that communicates with the discharge space D. Each of the suction port 101 and the discharge port 103 may be fixed to the casing 101 to allow the refrigerant to be suctioned into the casing 110 or discharged outside of the casing 110.

A motor may be disposed in the suction space S. The motor may include a stator 112 coupled to an inner wall of the casing 110, a rotor 114 rotatably disposed within the stator 112, and a rotational shaft 116 that passes through a central portion of the stator 114.

A lower portion of the rotational shaft 116 may be rotatably supported by an auxiliary bearing 117 disposed on or at a lower portion of the casing 110. The auxiliary bearing 117 may be coupled to a lower frame 118 to stably support the rotational shaft 116.

The lower frame 118 may be fixed to the inner wall of the casing 110, and an upper space of the lower frame 118 may be used as an oil storage space. Oil stored in the oil storage space may be transferred upward by an oil supply passage 116*a* defined in the rotational shaft 116 and uniformly supplied into the casing 110. The oil supply passage 116*a* may be eccentrically disposed toward one side of the rotational shaft 116, so that the oil introduced into the oil supply passage 116*a* may flow upward by a centrifugal force generated by rotation of the rotational shaft 116.

The scroll compressor 100 may further include a main frame 120. The main frame 120 may be fixed to the inner wall of the casing 110 and disposed in the suction space S.

An upper portion of the rotational shaft 116 may be rotatably supported by the main frame 120. A main bearing 122 that protrudes in a downward direction may be disposed on a bottom surface of the main frame 120. The rotational shaft 116 may be inserted into the main bearing 122. An inner wall of the main bearing 122 may function as a bearing surface so that the rotational shaft 116 may smoothly rotate.

The scroll compressor 100 may further include an orbiting scroll 130, and a fixed scroll 140. The orbiting scroll 130 may be seated on a top surface of the main frame 120.

The orbiting scroll 130 may include an orbiting head plate 133 having an approximately disk shape and disposed on the main frame 120, and an orbiting wrap 134 having a spiral shape and extending from the orbiting head plate 133. The orbiting head plate 133 may define a lower portion of the orbiting scroll 130 and function as a main body of the orbiting scroll 130, and the orbiting wrap 134 may extend in an upward direction from the orbiting head plate 133 to define an upper portion of the orbiting scroll 130. The orbiting wrap 134 together with a fixed wrap 144 of the fixed scroll 140 may define a compression chamber. The orbiting scroll 130 may be referred to as a "first scroll", and the fixed scroll 140 may be referred to as a "second scroll".

The orbiting head plate 133 of the orbiting scroll 130 may revolve in a state in which the orbiting head plate 133 is supported on the top surface of the main frame 120. An Oldham ring 136 may be disposed between the orbiting head plate 133 and the main frame 120 to prevent the orbiting scroll 130 from revolving. Also, a boss 138, into which the upper portion of the rotational shaft 116 may be inserted, may be disposed on a bottom surface of the orbiting head plate 133 of the orbiting scroll 130 to easily transmit a rotational force of the rotational shaft 116 to the orbiting scroll 130.

The fixed scroll 140 engaged with the orbiting scroll 130 may be disposed on the orbiting scroll 130. The fixed scroll 140 may include a plurality of coupling guides 141, each of which may define a guide hole 141*a*.

The orbiting scroll 100 may further includes a guide pin 142 inserted into the guide hole 141*a* and disposed on a top surface of the main frame 120, and a coupling member 145*a* inserted into the guide pin 142 and fitted into an insertion hole 125 of the main frame 120.

The fixed scroll 140 may include a fixed head plate 143 having an approximately disk shape, and the fixed wrap 144 that extends from the fixed head plate 143 toward the orbiting head plate 133 and engaged with the orbiting wrap 134 of the orbiting scroll 130. The fixed head plate 143 may define an upper portion of the fixed scroll 140 and function as a main body of the fixed scroll 140, and the fixed wrap 144 may extend in a downward direction from the fixed head plate 143 to define a lower portion of the fixed scroll 140. The orbiting head plate 133 may be referred to as a "first head plate", and the fixed head plate 143 may be referred to as a "second head plate". The orbiting wrap 134 may be referred to as a "first wrap", and the fixed wrap 144 may be referred to as a "second wrap".

An end of the fixed wrap 144 may be disposed to contact the orbiting head plate 133, and an end of the orbiting wrap 134 may be disposed to contact the fixed head plate 143. The fixed wrap 144 may disposed in a predetermined spiral shape, and a discharge hole 145, through which the compressed refrigerant may be discharged, may be defined in an approximately central portion of the fixed head plate 143. A suction hole (see reference numeral 146 of FIG. 5), through which the refrigerant within the suction space S may be suctioned, may be defined in a side surface of the fixed scroll 140. The refrigerant suctioned through the suction hole 146 may be introduced into the compression chamber defined by the orbiting wrap 134 and the fixed wrap 144.

In detail, the fixed wrap 144 and the orbiting wrap 134 may define a plurality of compression chambers. Each of the plurality of compression chambers may be reduced in volume while revolving and moving toward the discharge hole 145 to compress the refrigerant. Thus, the compression chamber, which is adjacent to the suction hole 146, of the plurality of compression chambers may be minimized in pressure, and the compression chamber that communicates with the discharge hole 145 may be maximized in pressure. Also, the compression chamber between the above-described compression chambers may have an intermediate pressure that corresponds to a pressure between a suction pressure of the suction hole 146 and a discharge pressure of the discharge hole 145. The intermediate pressure may be applied to a back pressure chamber BP, which will be described hereinbelow, to press the fixed scroll 140 toward the orbiting scroll 130.

An intermediate pressure discharge hole 147 that transfers the refrigerant of the compression chamber having the intermediate pressure to the back pressure chamber BP may be defined in the fixed head plate 143 of the fixed scroll 140. That is, the intermediate pressure discharge hole 147 may be defined in one portion of the fixed scroll 140 so that the compression chamber that communicates with the intermediate pressure discharge hole 147 has a pressure greater than the suction pressure in the suction space S and less than the discharge pressure in the discharge space D. The intermediate pressure discharge hole 147 may pass through the fixed head plate 143 from a top surface to a bottom surface of the fixed head plate 143.

A back pressure chamber assembly 400 disposed above the fixed scroll 140 to define the back pressure chamber may be disposed on the fixed scroll 140. The back pressure chamber assembly 400 may include a back pressure plate 150, and a floating plate 160 separably coupled to the back pressure plate 150. The back pressure plate 150 may be fixed to an upper portion of the fixed head plate 143 of the fixed scroll 140.

The back pressure plate 150 may have an approximately annular shape with a hollow and include a support 152 that contacts the fixed head plate 143 of the fixed scroll 140. An intermediate pressure suction hole 153 that communicates with the intermediate pressure discharge hole 147 may be defined in the support 152. The intermediate pressure suction hole 153 may pass through the support 152 from a top surface to a bottom surface of the support 152.

A second coupling hole 154 that communicates with the first coupling hole 148 defined in the fixed head plate 143 of the fixed scroll 140 may be defined in the support 152. The first coupling hole 148 and the second coupling hole 154 may be coupled to each other by a coupling member (not shown).

The back pressure plate 150 may include a plurality of walls 158 and 159 that extend in an upward direction from the support 152. The plurality of walls 158 and 159 may include a first wall 158 that extends in the upward direction from an inner circumferential surface of the support 152, and a second wall 159 that extends in the upward direction from an outer circumferential surface of the support 152. Each of the first and second walls 158 and 159 may have an approximately cylindrical shape.

The first and second walls 158 and 159 together with the support 152 may define a space. A portion of the space may be a back pressure chamber BP.

The first wall 158 may include a top surface 158*a* that defines a top surface of the first wall 158. The first wall 158 may include at least one intermediate discharge hole 158*b* that communicates with the discharge hole 145 of the fixed head plate 143 to discharge the refrigerant discharged from the discharge hole 145 toward the discharge cover 105. The intermediate discharge hole 158*b* may pass from a bottom surface of the first wall 158 to the top surface 158*a*. An inner space of the first wall 158 having a cylindrical shape may communicate with the discharge hole 145 to define a portion of a discharge passage through which the discharged refrigerant may flow into the discharge space D.

A discharge valve 108 having an approximately circular pillar shape may be disposed inside the first wall 158. The discharge valve 108 may be disposed above the discharge hole 145 and have a size sufficient to completely cover the discharge hole 145. For example, the discharge valve 108 may have an outer diameter greater than a diameter of the discharge hole 145. Thus, when the discharge valve 108 contacts the fixed head plate 143 of the fixed scroll 140, the discharge valve 108 may close the discharge hole 145.

The discharge valve 108 may be movable in upward or downward directions according to a variation in pressure applied to the discharge valve 108. Also, the inner circumferential surface of the first wall 158 may define a moving guide 158*c* that guides movement of the discharge valve 108.

A discharge pressure apply hole 158*d* may be defined in the top surface 158*a* of the first wall 158. The discharge pressure apply hole 158*d* may communicate with the discharge hole 105*a*. The discharge pressure apply hole 158*d* may be defined in an approximately central portion of the top surface 158*a*, and the plurality of intermediate discharge holes 158*b* may be disposed to surround the discharge pressure apply hole 158*d*.

For example, when operation of the scroll compressor 100 is stopped, if the refrigerant flows backward from the discharge space D toward the discharge hole 145, the pressure applied to the discharge pressure apply hole 158*d* may be greater than the discharge hole-side pressure. That is, the pressure may be applied downward to a top surface of the discharge valve 108, and thus, the discharge valve 108 may move downward to close the discharge hole 145.

On the other hand, if the scroll compressor 100 operates to compress the refrigerant in the compression chamber, when the discharge hole-side pressure is greater than the pressure in the discharge space D, an upward pressure may be applied to a bottom surface of the discharge valve 108, and thus, the discharge valve 108 may move upward to open the discharge hole 145. When the discharge hole 145 is opened, the refrigerant discharged from the discharge hole 145 may flow toward the discharge cover 105 via the intermediate discharge hole 158*b*, and then, may be discharged outside of the scroll compressor 100 through the discharge port 103 via the discharge hole 105*a*.

The back pressure plate 150 may further include a step 158*e* disposed inside a portion at which the first wall 158 and the support 152 are connected to each other. The refrigerant discharged from the discharge hole 145 may reach a space defined by the step 158*e* and then flow to the intermediate discharge hole 158*b*.

The second wall 159 may be spaced a predetermined distance from the first wall 158 to surround the first wall 158. The back pressure plate 150 may have a space having an approximately U-shaped cross-section formed by the first wall 158, the second wall 159, and the support 152. The floating plate 160 may be accommodated in the space. The space, which may be covered by the floating plate 160, may form the back pressure chamber BP. On the other hand, the first and second walls 158 and 159 of the back pressure plate 150, the support 152, and the floating plate 160 may define the back pressure chamber BP.

The floating plate 160 may include an inner circumferential surface that faces an outer circumferential surface of the first wall 158, and an outer circumferential surface that faces an inner circumferential surface of the second wall 159. That is, the inner circumferential surface of the floating plate 160 may contact the outer circumferential surface of the first wall 158, and the outer circumferential surface of the floating plate 160 may contact the inner circumferential surface of the second wall 159.

The floating plate 160 may have an inner diameter equal to or greater than an outer diameter of the first wall 158 of the back pressure plate 150. The floating plate 160 may have an outer diameter equal to or less than an inner diameter of the second wall 159 of the back pressure plate 150.

A rib 164 that extends in an upward direction may be disposed on a top surface of the floating plate 160. For example, the rib 164 may extend in the upward direction from the inner circumferential surface of the floating plate 160.

When the floating plate 160 ascends, the rib 164 may contact a bottom surface of the discharge cover 105. When the rib 164 contacts the discharge cover 105, communication between the suction space S and the discharge space D may be blocked. On the other hand, when the rib 164 is spaced apart from the bottom surface of the discharge cover 105, that is, when the rib 164 moves in a direction away from the discharge cover 105, the suction space S and the discharge space D may communicate with each other.

In detail, while the scroll compressor 100 operates, the floating plate 160 may move upward to allow the rib 164 to contact the bottom surface of the discharge cover 105. Thus, the refrigerant discharged from the discharge hole 145 to pass through the intermediate discharge hole 158*b* may not leak into the suction space S, but rather, may be discharged into the discharge space D.

On the other hand, when the scroll compressor 100 is stopped, the floating plate 160 may move downward to allow the rib 164 to be spaced apart from the bottom surface of the discharge cover 105. Thus, the discharged refrigerant disposed at the discharge cover-side may flow toward the suction space S through the space between the rib 164 and the discharge cover 105. Also, when the scroll compressor 100 is stopped, the floating plate 160 may move upward to allow the rib 164 to be spaced apart from the bottom surface of the discharge cover 105.

Figure 5:
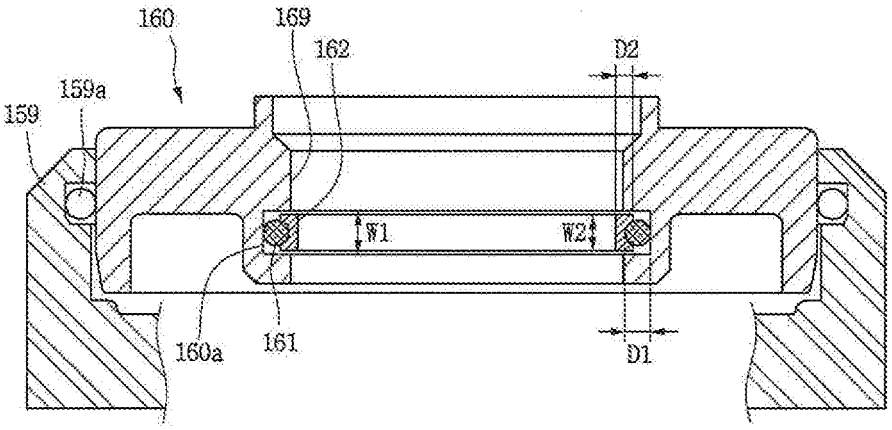
FIG. 5 is a view illustrating a bottom surface of a back pressure plate and a floating plate according to an embodiment.
Figure 6:
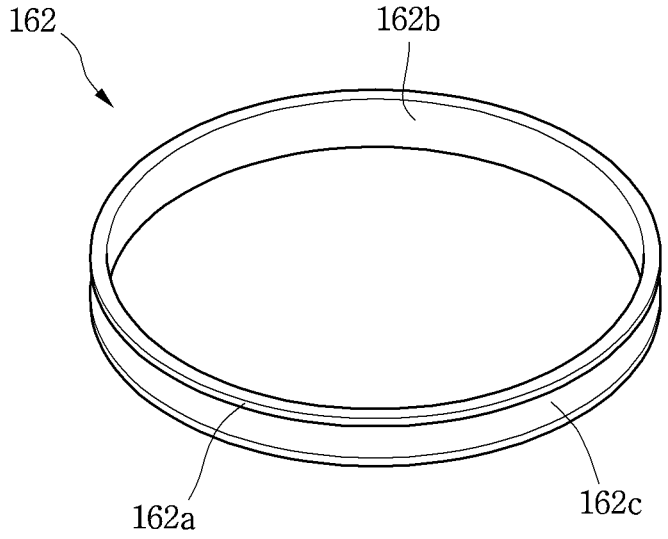
FIG. 6 is a perspective view illustrating a seal cover of a second sealing member according to an embodiment.
Figure 7:
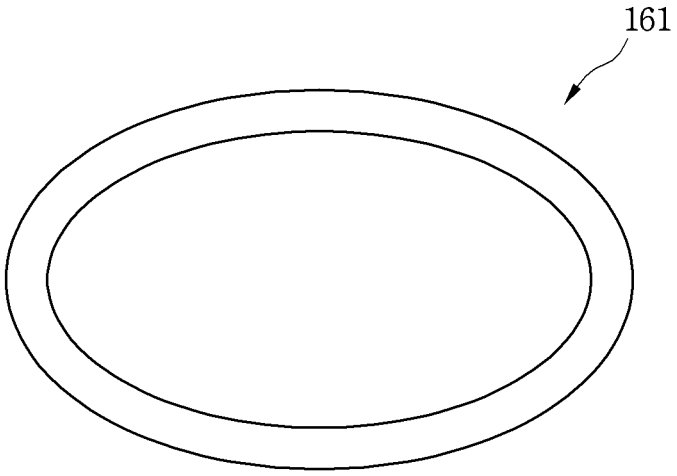
FIG. 7 is a view illustrating a seal of the second sealing member.

FIG. 5 is a view illustrating a bottom surface of a back pressure plate and a floating plate according to an embodiment. FIG. 6 is a perspective view illustrating a seal cover of a second sealing member according to an embodiment. FIG. 7 is a view illustrating a seal of the second sealing member.

Referring to FIGS. 4 to 7, sealing members 159*a*, 161, and 162 to prevent the refrigerant within the back pressure chamber BP from leaking may be disposed on at least one of the first and second walls 158 and 159 and the floating plate 160. The sealing members 159*a*, 161, and 162 may include a first sealing member 159*a* to prevent the refrigerant from leaking between an inner circumferential surface of the second wall 159 and an outer circumferential surface of the floating plate 160, and second sealing members 161 and 162 to prevent the refrigerant from leaking between an outer circumferential surface of the first wall 158 and an inner circumferential surface of the floating plate 160.

For example, the first sealing member 159*a* may be disposed on the inner circumferential surface of the second wall 159, and the second sealing members 161 and 162 may be disposed on the inner circumferential surface of the floating plate 160. Alternatively, the first sealing member 159*a* may be disposed on the outer circumferential surface of the floating plate 160, and the second sealing members 161 and 162 may be disposed on the outer circumferential surface of the first wall 158.

Leakage between the first and second walls 158 and 159 and the floating plate 160, that is, refrigerant leakage from the back pressure chamber BP may be prevented by the sealing members 159*a*, 161, and 162. The first wall 158 may have an outer diameter less than a diameter of an inner circumferential surface of the floating plate 160.

For example, the first sealing member 159*a* may include a seal. The second sealing member 161, 162 may include a seal cover 162, and a seal 161 coupled to an outer circumferential surface of the seal cover 162. The seal 161 may be a ring type seal. A groove 160*a* to accommodate the second sealing members 161 and 162 may be defined in the inner circumferential surface of the floating plate 160.

In this embodiment, a sliding surface of the floating plate 160 may be referred to as a first surface 169, and a surface that faces the first surface 169 of the back pressure plate 150 may be referred to as a second surface 158*f*. Also, the second sealing members 161 and 162 may be disposed on one of the first surface 169 of the floating plate 160 and the second surface 158*f* of the back pressure plate 150. Hereinafter, a structure ire which the sealing members 161 and 162 are disposed on the first surface 169, that is, the inner circumferential surface of the floating plate 160 will be disclosed herein.

An inner circumferential surface 162*b* of the seal cover 162 may have a diameter less than an outer diameter of the first wall 158. If the second sealing members 161 and 162 are disposed on the second surface of the back pressure plate 150, the seal 161 may be disposed on the inner circumferential surface of the seal cover 162, and an outer circumferential surface of the seal cover 162 may have a diameter greater than the inner circumferential surface of the floating plate 160.

A seal accommodation groove 162*c* to accommodate the seal 161 may be defined in the outer circumferential surface 162*a* of the seal cover 162. A vertical cross-section of the seal accommodation groove 162*c* may have an area less than a half of an area of a vertical cross-section of the seal 161. Thus, in a state in which the seal 161 is accommodated in the seal accommodation groove 162*c*, elastic deformation of the seal 161 may increase. Thus, a contact area between the groove 160*a* of the floating plate 160 and the seal 161 may be sufficiently secured to improve sealing performance.

In a state in which the seal 161 is fitted into the seal accommodation groove 162*c* of the seal cover 162, the seal cover 162 and the seal 161 may be accommodated in the groove 160*a* defined in the inner circumferential surface of the floating plate 160. The seal 161 may have an outer diameter greater than a diameter of the groove 160*a* of the floating plate 160. Also, the groove 160*a* of the floating plate 160 may have a width W1 greater than a width W2 of the seal cover 162 and a cross-sectional diameter D1 of the seal 161. Thus, in the state in which the second sealing members 161 and 162 are accommodated in the groove 160*a* of the floating plate 160, the second sealing members 161 and 162 may vertically move in FIG. 5.

Also, the width D2 of the seal cover 162 may be greater than the cross-sectional diameter D1 of the seal 161. Also, in a state in which the second sealing members 161 and 162 are accommodated in the groove 160*a* of the floating plate 160, the inner circumferential surface 162*b* of the seal cover 162 may contact the outer circumferential surface of the first wall 158.

Also, a sum of the cross-sectional diameter D1 of the seal 161 and a minimum thickness in the cross-section of the seal cover 162 may be greater than a distance between the inner circumferential surface of the groove 160*a* of the floating plate 160 and the first wall 158. Thus, when the first wall 158 passes through the second sealing members 161 and 162, the seal 161 may be pressed by the first wall 158 to realize sealing between the seal 161 and the groove 160*a* of the floating plate 160.

In this embodiment, the seal cover 162 may be formed of Teflon, in particular, of a poly tetra fluoro ethylene (PTFE) material. The PTFE may have a low friction coefficient, high elastic coefficient, and high thermal stability.

Also, in this embodiment, the seal cover 162 may include a filler to improve a wear property. The filler may include glass fiber or mineral fiber and graphite. As the glass fiber or mineral fiber and the graphite are contained in the PTFE, strain at a high or low temperature may be reduced, and abrasion and friction performance may be improved.

The seal cover 162 may have a low friction coefficient because the seal cover 162 contacts the first wall 158. The seal cover 162 may have a friction coefficient less than a friction coefficient of the seal 161. For example, the seal cover 162 may have a friction coefficient of about 0.04 to about 0.10. Also, a general seal may have a friction coefficient more than 10 times the friction coefficient of the seal cover 162, even though the friction coefficient varies according to a material of the seal 161. In this embodiment, the seal 161 may have a friction coefficient of about 1.2 to about 1.8.

On the other hand, the seal cover 162 may have an elastic coefficient greater than an elastic coefficient of the seal 161. Thus, even though the first wall 158 passes through the second sealing members 161 and 162 in the state in which the second sealing members 161 and 162 are accommodated in the groove 160*a* of the floating plate 160, the seal cover 162 may not be deformed.

If sealing is performed using the seal 161, the friction coefficient of the seal 161 may increase. Also, as the seal 161 is pressed by the first wall 158, the contact area between the seal 161 and the first wall 158 may increase. Thus, the floating plate 160 may not smoothly move downward, restricting rapid re-operation of the scroll compressor 100.

However, according to this embodiment, as the seal cover 162 having the friction coefficient less than the friction coefficient of the seal 161 directly contacts the first wall 158, the floating plate 160 may smoothly move downward when the scroll compressor 100 stops to quickly re-operate the compressor. In addition, the seal 161 may be maintained in the state in which the seal 161 is closely attached to the groove 160*a* of the floating plate 160 to prevent the refrigerant from flowing between the seal 161 and the groove 160*a* of the floating plate 160.

In this embodiment, a difference between the intermediate pressure and the discharge pressure may be greater than a difference between the intermediate pressure and the suction pressure. Thus, as a pressure applied to the seal of the second sealing member disposed on a boundary between a portion at which the intermediate pressure is generated and a portion at which the discharge pressure is generated is high, the second sealing member including the seal cover 162 and the seal 161 may be disposed on the inner circumferential surface of the floating plate 160 that corresponds to the boundary between the portion at which the intermediate pressure is generated and the portion at which the discharge pressure is generated. Alternatively, the first sealing member 159*a* may have a same configuration as each of the second sealing members 161 and 162. That is, the first sealing member 159*a* may also include a seal cover and a seal.

Figure 8:
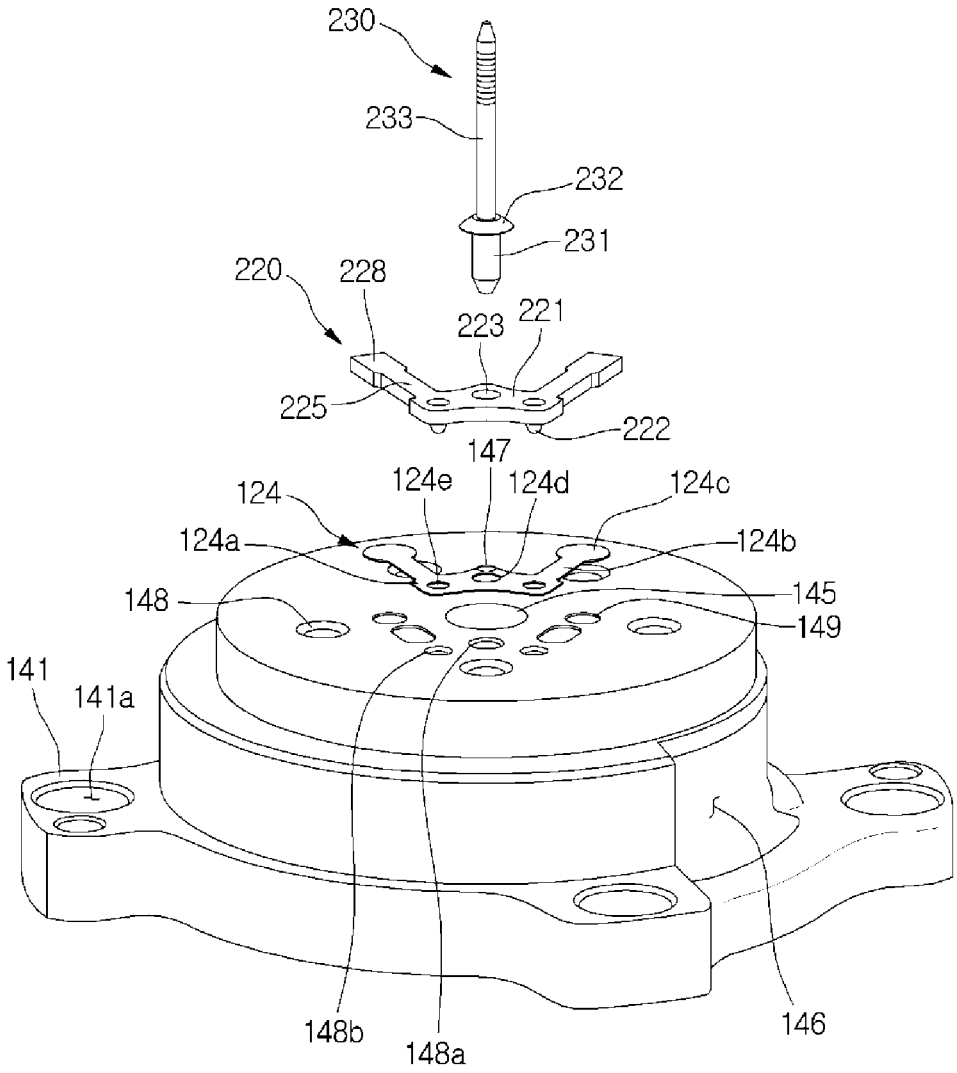
FIG. 8 is a perspective view of a fixed scroll according to an embodiment.
Figure 9:
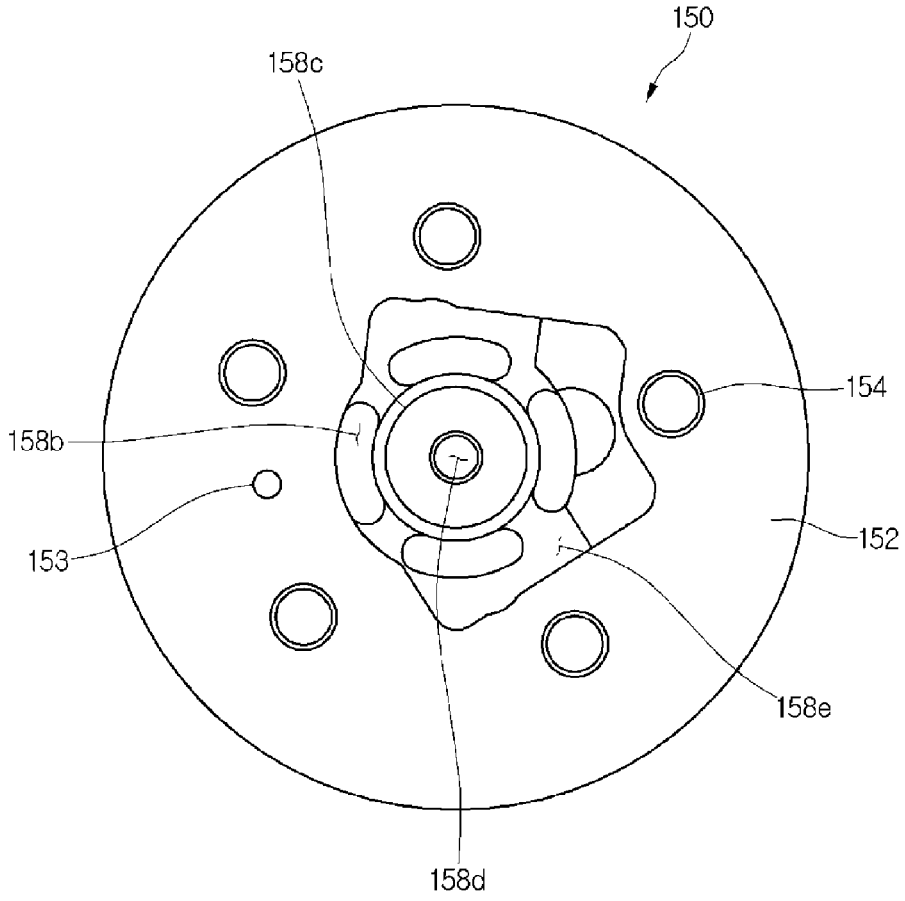
FIG. 9 is a view illustrating a bottom surface of the back pressure plate according to an embodiment.

FIG. 8 is a perspective view of a fixed scroll according to an embodiment. FIG. 9 is a view illustrating a bottom surface of the back pressure plate according to an embodiment.

Referring to FIGS. 3, 8 to 9, the fixed scroll 140 according to an embodiment may include at least one bypass hole 149 defined in one side of the discharge hole 145. Although two bypass holes 149 are shown in FIG. 8, embodiments are not limited to the number of bypass holes 149. Each bypass holes 149 may pass through the fixed head plate 143 to extend up to the compression chamber defined by the fixed wrap 144 and the orbiting wrap 134.

The bypass hole(s) 149 may be defined in different positions according to operation conditions. For example, the bypass hole 149 may communicate with the compression chamber having a pressure greater by about 1.5 times than the suction pressure. Also, the compression chamber that communicates with the bypass hole 149 may have a pressure greater than the pressure of the compression chamber that communicates with the intermediate pressure discharge hole 147.

The scroll compressor 100 may further include a bypass valve 124 that opens and closes the bypass hole(s) 149, a stopper 220 that restricts a moving distance of the bypass valve 124 when the bypass valve 124 opens the bypass hole(s) 149, and a coupling member 230 that couples the bypass valve 124 and the stopper 220 to the fixed scroll 140 at the same time. In detail, the bypass valve 124 may include a valve support 124*a* fixed to the fixed head plate 143 of the fixed scroll 140 by the coupling member 230. The bypass valve 124 may further include at least one connection portion 124*b* that extends from the valve support 124*a*, and at least one valve body 124*c* disposed on or at a side of the connection portion 124*b*. Each of the at least one connection portion 124*b* and the at least one valve body 124*c* may be provided in a same number as a number of the bypass hole(s) 149. For example, FIG. 5 illustrates the bypass valve 124 including two connection portions 124*b* and two valve bodies 124*c*.

The valve body 124*c* may be maintained in contact with the top surface of the fixed head plate 143 and have a size sufficient to cover the bypass hole 149. Further, the valve body 124*c* may be moved by a pressure of the refrigerant flowing along the bypass hole 149 to open the bypass hole 149. Thus, the connection portion 124*b* may have a size less than a diameter of the valve body 124*c* so that the valve body 124*c* may smoothly move.

When the bypass valve 124 opens the bypass hole 149, the refrigerant of the compression chamber that communicates with the bypass hole 149 may flow into a space between the fixed scroll 140 and the back pressure plate 150 through the bypass hole 149 to bypass the discharge hole 145. The bypassed refrigerant may flow toward the discharge hole 105*a* of the discharge cover 105 via the intermediate discharge hole 158*b*.

The stopper 220 may be disposed above the bypass valve 124. The stopper 220 may have a shape corresponding to a shape of the bypass valve 124. The bypass valve 124 may be elastically deformed by the refrigerant pressure. As the stopper 220 restricts movement of the bypass valve 124, the stopper 220 may have a thickness greater than a thickness of the bypass valve 124.

The stopper 220 may include a stopper support 221 that contacts the valve support 124*a*. The stopper 220 may further include at least one connection portion 225 that extends from the stopper support 221, and at least one stopper body 228 disposed on or at one side of the connection portion 225. Each of the at least one connection portion 225 of the at least one stopper 220 and the at least one stopper body 228 may be provided in a same number as a number of the connection portions 124*b* of the bypass valve 124 and the valve body 124*c*.

Each connection portion 225 of the stopper 220 may be inclined in an upward direction away from the stopper support 221. Thus, the valve body 124*c* may contact a top surface of the fixed head plate 143, and the stopper body 228 may be spaced apart from a top surface of the valve body 124*c* in a state in which the bypass valve 124 and the stopper 220 are coupled to the fixed head plate 143 by the coupling member 230. When the valve body 124*c* is lifted upward by the refrigerant flowing through the bypass hole 149, the top surface of the valve body 124*c* may contact the stopper body 228, and thus, the valve body 124*c* may be stopped.

Coupling holes 223 and 124*d*, to which the coupling member 230 may be coupled, may be defined in the stopper support 221 and the bypass valve 124. A coupling groove 148*a*, to which the coupling member 230 may be coupled, may be defined in the fixed head plate 143.

At least one guide protrusion 222 to maintain an arranged state of the coupling holes 223 and 124*d* and the coupling groove 148*a* before the coupling member 230 is coupled to each of the coupling holes 223 and 124*d* and the coupling groove 149*a* may be disposed on the stopper support 221. At least one protrusion through-hole 124*e*, through which the guide protrusion 222 may pass, may be defined in the valve support 221. At least one protrusion accommodation groove 148*b* that accommodates the guide protrusion 222 may be defined in the fixed head plate 143. Thus, when the guide protrusion 222 of the stopper 220 is accommodated into the protrusion accommodation groove 148*b* in a state in which the guide protrusion 222 passes through the protrusion through-hole 124*e* of the bypass valve 124, the stopper support 221, the bypass valve 124, and each of the coupling holes 223 and 124*d* and the coupling groove 149*a* of the fixed head plate 143 may be aligned with each other.

The stopper 220 may include a plurality of the guide protrusion 222, the bypass valve 124 may include a plurality of the through-hole 124*e*, and the fixed scroll 140 may include a plurality of the protrusion accommodation groove 148*b*, so that the stopper support 221, the bypass valve 124, and the coupling holes 223 and 124*d* and coupling groove 148*a* of the fixed head plate 143 may be more accurately aligned with each other. In this case, the coupling groove 223 may be disposed between the plurality of guide protrusions 222 of the stopper 220. Also, the coupling groove 124*d* may be disposed between the plurality of through-holes 124*e* of the bypass valve 124, and the coupling groove 148*a* may be disposed between the plurality of protrusion accommodation grooves 148*b* of the fixed head plate 143.

The coupling member 230 may be a rivet, for example. The coupling member 230 may include a coupling body 231 coupled to the stopper support 221, the bypass valve 124, and the coupling holes 223 and 124*d* and the coupling groove 148*a* of the fixed head plate 143, a head 232 disposed on the coupling body 231 to contact a top surface of the stopper support 221, and a separation portion 233 that passes through the head 232, disposed inside the coupling body 231, and being separable from the coupling body 231. When the separation portion 233 is pulled upward in FIG. 5, the separation portion 233 may be separated from the coupling body 231.

According to this embodiment, a configuration and coupling method of the coupling member 230 may be realized through well-known technology, and thus, detailed description thereof has been omitted.

The intermediate pressure discharge hole 147 of the fixed scroll 140 and the intermediate pressure suction hole 153 of the back pressure plate 150 may be disposed to be aligned with each other. The refrigerant discharged from the intermediate pressure discharge hole 147 may be introduced into the back pressure chamber BP via the intermediate pressure suction hole 153. The intermediate pressure discharge hole 147 and the intermediate pressure suction hole 153 may be referred to as a "bypass passage" in that the refrigerant of the back pressure chamber BP may be bypassed to the compression chamber through the intermediate pressure discharge hole 147 and the intermediate pressure suction hole 153.

Figure 10:
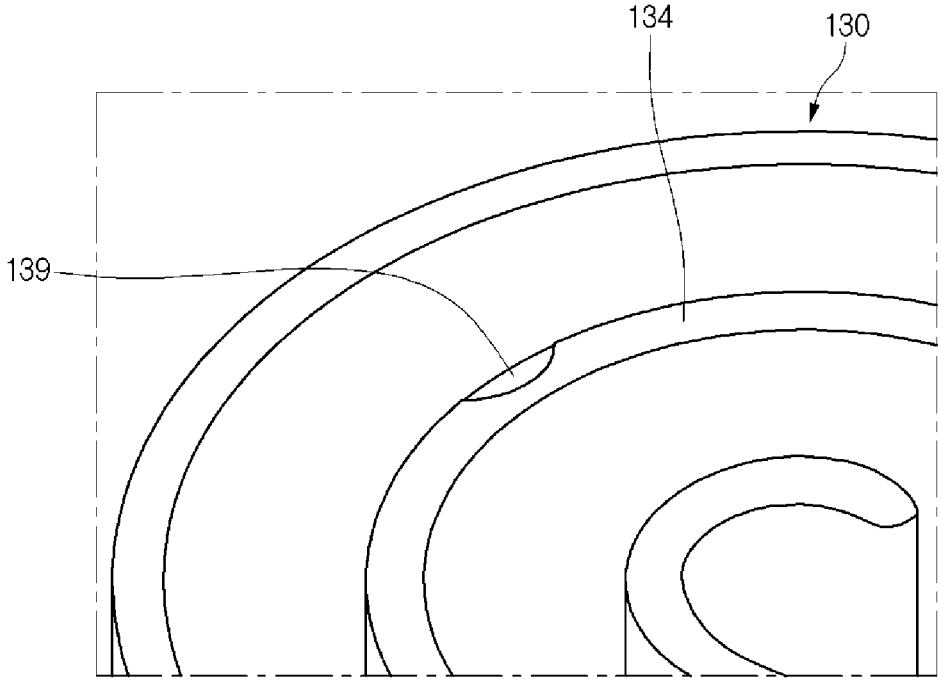
FIG. 10 is a partial view of an orbiting scroll according to an embodiment.
Figure 11:
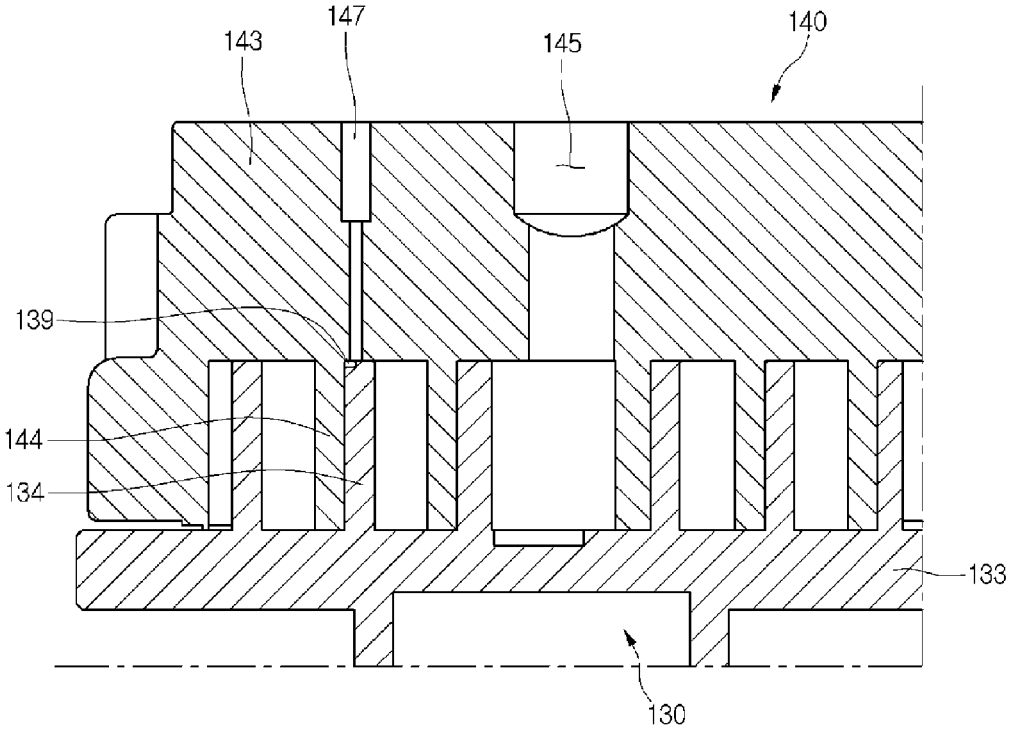
FIG. 11 is a cross-sectional view illustrating a state in which the fixed scroll and the orbiting scroll are coupled to each other according to an embodiment.
Figure 12A:
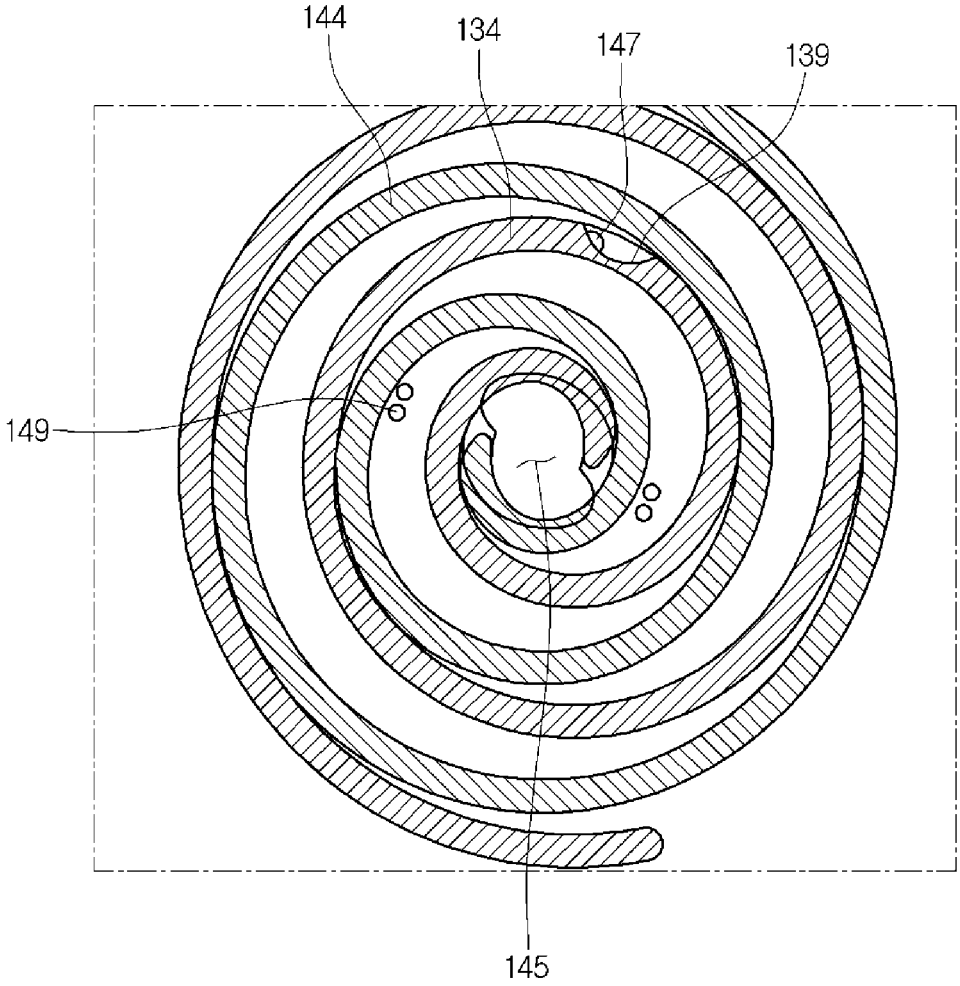
FIGS. 12A to 12C are views illustrating relative positions of an intermediate pressure discharge hole of the fixed scroll and a discharge guide of the orbiting scroll while the orbiting scroll revolves.
Figure 12B:
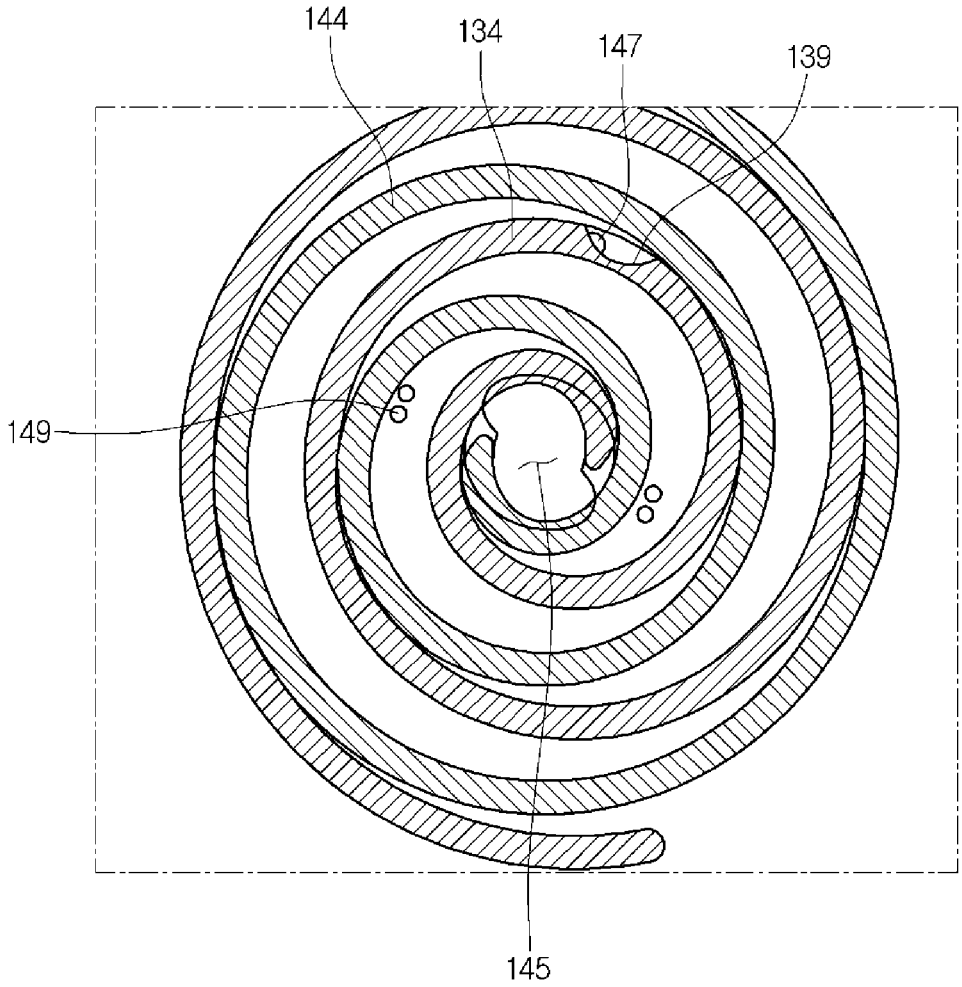
Figure 12C:
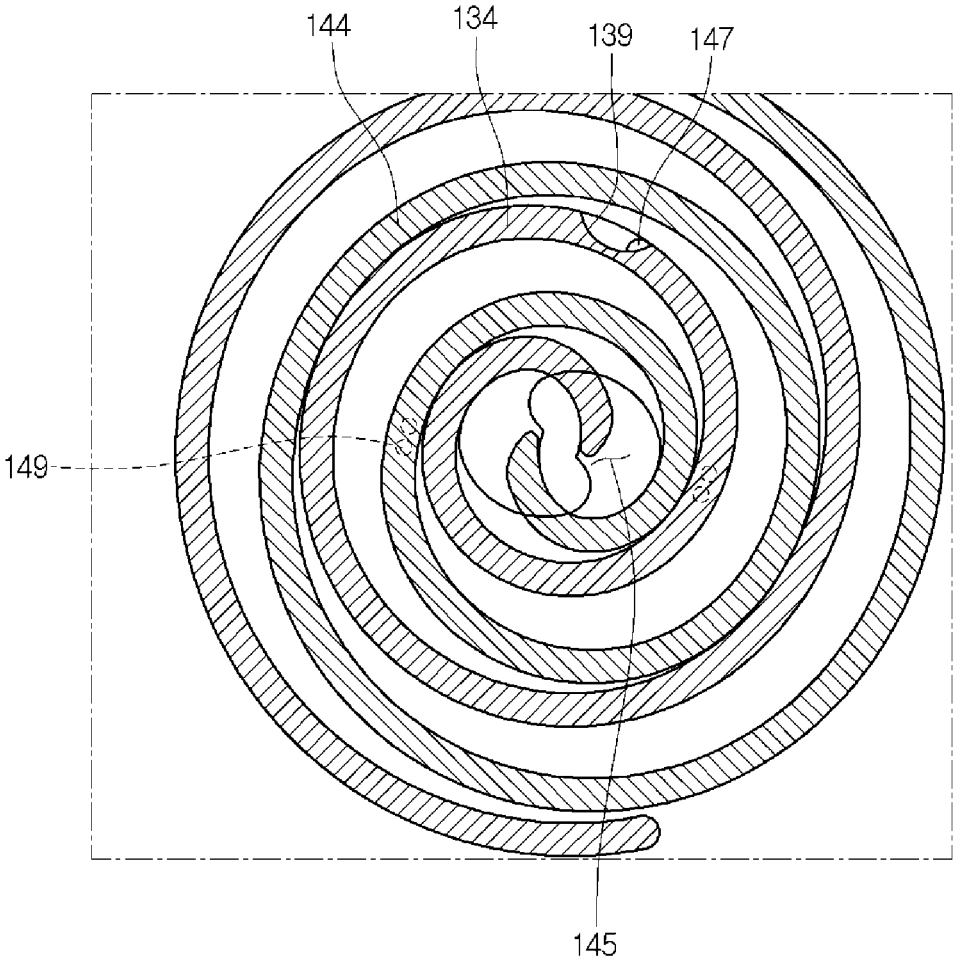
Figure 13A:
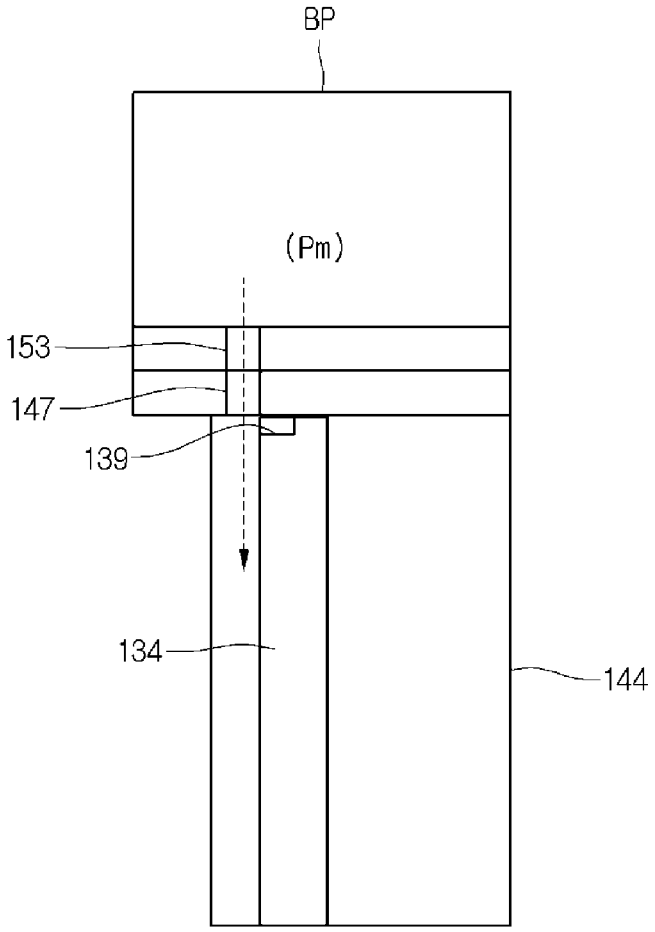
FIGS. 13A and 13B are schematic views of a state in which an intermediate pressure refrigerant of a back pressure chamber is discharged into the compression chamber through the discharge guide according to a position of the orbiting scroll.
Figure 13B:
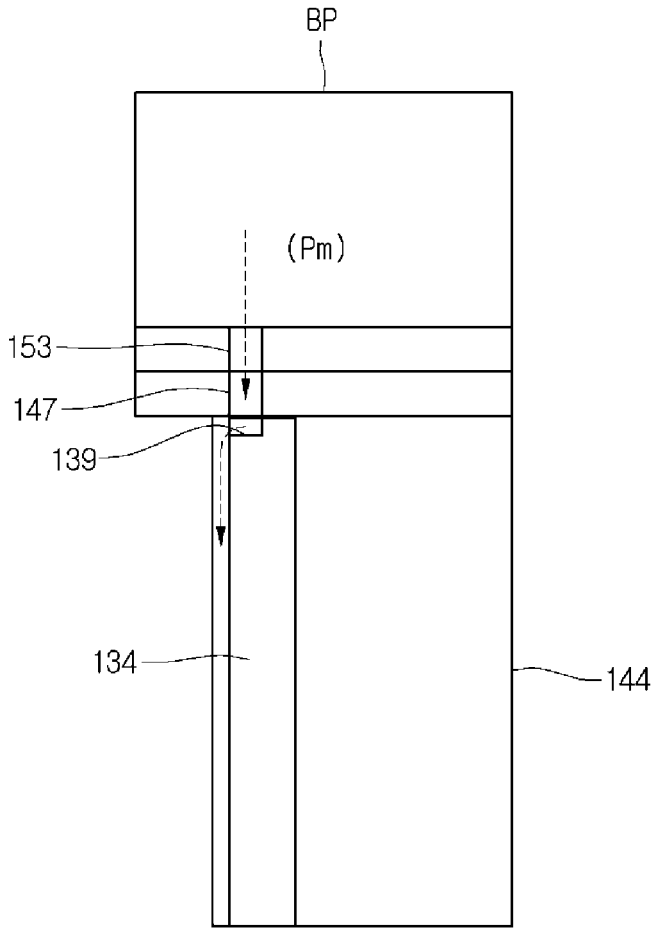

FIG. 10 is a partial view of an orbiting scroll according to an embodiment. FIG. 11 is a cross-sectional view illustrating a state in which the fixed scroll and the orbiting scroll are coupled to each other according to an embodiment. FIGS. 12A to 12C are views illustrating relative positions of an intermediate pressure discharge hole of the fixed scroll and a discharge guide of the orbiting scroll while the orbiting scroll revolves. FIGS. 13A and 13B are schematic views of a state in which the intermediate pressure refrigerant of the back pressure chamber is discharged into the compression chamber through the discharge guide according to a position of the orbiting scroll.

Referring to FIGS. 10 and 11, the orbiting scroll 130 may include a discharge guide 139 to guide the refrigerant flowing into the intermediate pressure discharge hole 147 so that the refrigerant may be introduced into a space (region) having a pressure less than a pressure of the back pressure chamber BP. In detail, when operation of the scroll compressor 100 is stopped, the compression chamber defined by the orbiting wrap 134 and the fixed wrap 144 vanishes, and thus, the refrigerant flows into the space (region) between the orbiting wrap 134 and the fixed wrap 144. The space (region) may have a pressure less than a pressure of the back pressure chamber BP. The space (region) may be referred to as a "wrap space".

The discharge guide 139 may be recessed from an end surface of the orbiting wrap 134 of the orbiting scroll 130. Thus, the discharge guide 139 may be referred to as a "recess". The end surface of the orbiting wrap 134 may be understood as a surface of the orbiting wrap 134 that faces the fixed head plate 143 of the fixed scroll 140 or a surface of the orbiting wrap 134 that contacts the fixed head plate 143.

A width of the end surface of the orbiting wrap 134, that is, a thickness of the orbiting wrap 134 may be greater than a width of the intermediate pressure discharge hole 147. Also, the discharge guide 139 may be recessed from the end surface of the orbiting wrap 134 by a preset or predetermined width and depth.

While the orbiting scroll 130 revolves, the orbiting wrap 134 may be disposed directly below the intermediate pressure discharge hole 147 or be disposed to be spaced horizontally from a lower end of the intermediate pressure discharge hole 147 to open the intermediate pressure discharge hole 147. If the discharge guide 139 is not provided, when the orbiting wrap 134 is disposed directly below the intermediate pressure discharge hole 147 (in FIG. 10), the orbiting wrap 134 may cover the intermediate pressure discharge hole 147. On the other hand, when the orbiting wrap 134 moves horizontally by a predetermined distance, at least a portion of the intermediate pressure discharge hole 147 may be opened. Also, while the scroll compressor 100 operates, when the intermediate pressure discharge hole 147 is opened, the intermediate pressure refrigerant of the compression chamber may be introduced into the back pressure chamber BP through the intermediate pressure discharge hole 147.

On the other hand, in a state in which the scroll compressor 100 is stopped, when the orbiting wrap 134 is disposed directly below the intermediate pressure discharge hole 147 to block the intermediate pressure discharge hole 147, the refrigerant of the back pressure chamber BP may not be introduced into the wrap space through the intermediate pressure discharge hole 147. As a result, an equilibrium pressure may not be maintained, and thus, quick re-operation of the compressor may be limited.

Thus, according to this embodiment, the discharge guide 139 may be disposed in the orbiting wrap 134 to prevent the intermediate pressure discharge hole 147 from being completely covered or shielded, and thus, even though the orbiting wrap 134 is disposed directly below the intermediate pressure discharge hole 147, the intermediate pressure discharge hole 147 and the compression chamber (when the compressor operates) or the intermediate pressure discharge hole 147 and the wrap space (when the compressor stops) may communicate with each other.

Referring to FIGS. 12A to 12C, the plurality of compression chambers is formed while the orbiting scroll 130 revolves, and then, the plurality of compression chambers moves toward the discharge hole 145 while being reduced in volume. With this process, the orbiting wrap 134 of the orbiting scroll 130 may selectively open the bypass hole 149. For example, when the orbiting wrap 134 opens the bypass hole 149, the refrigerant of the compression chamber that communicates with the bypass hole 149 may flow into the bypass hole 149 to bypass the discharge hole 145. On the other hand, when the orbiting wrap 134 covers the bypass hole 149, flow of the refrigerant of the compression chamber into the bypass hole 149 may be limited.

The back pressure chamber BP and the intermediate pressure discharge hole 147 may always communicate with the compression chamber via the discharge guide 139. That is, the discharge guide 139 may be disposed on an end of the orbiting wrap 134 at a position at which the back pressure chamber BP and the intermediate pressure discharge hole 147 always communicate with the compression chamber.

In summary, even though the orbiting wrap 134 is disposed directly below the intermediate pressure discharge hole 147 while the orbiting wrap 134 revolves, the lower end of the intermediate pressure discharge hole 147 and the end surface of the orbiting wrap 134 may be spaced apart from each other by the recessed discharge guide 139. Thus, when the scroll compressor 100 operates, refrigerant of the compression chamber may be introduced into the back pressure chamber BP through the intermediate pressure discharge hole 147. Also, when the scroll compressor 100 is stopped, the refrigerant of the back pressure chamber BP may be introduced into the wrap space through the intermediate pressure discharge hole 147.

In detail, FIGS. 12A to 12C illustrate a state in which the orbiting wrap 134 is disposed directly below the intermediate pressure discharge hole 147 while the orbiting wrap 134 revolves, that is, the state in which the end surface of the orbiting wrap 134 is disposed to block the intermediate pressure discharge hole 147 if the discharge guide 139 is not provided.

Even though the orbiting wrap 134 is disposed as illustrated in FIGS. 12A to 12C, the intermediate pressure discharge hole 147 may communicate with the compression chamber by the discharge guide 139. Thus, as illustrated in FIG. 12B, the refrigerant of the back pressure chamber BP having an intermediate pressure Pm may be introduced into the wrap space between the orbiting wrap 134 and the fixed wrap 144 via the intermediate pressure discharge hole 147 and the discharge guide 139.

If the orbiting wrap 134 is disposed at a position that is not illustrated in FIGS. 12A to 12C, at least a portion of the intermediate pressure discharge hole 147 is opened. That is, the orbiting wrap 134 may be in a state in which the orbiting wrap 134 moves horizontally to open the at least a portion of a lower end of the intermediate pressure discharge hole 147. Thus, as illustrated in FIG. 13A, as the intermediate pressure discharge hole 147 is opened, the refrigerant of the back pressure chamber BP having the intermediate pressure Pm may be introduced into the wrap space through the intermediate pressure discharge hole 147.

Figure 14:
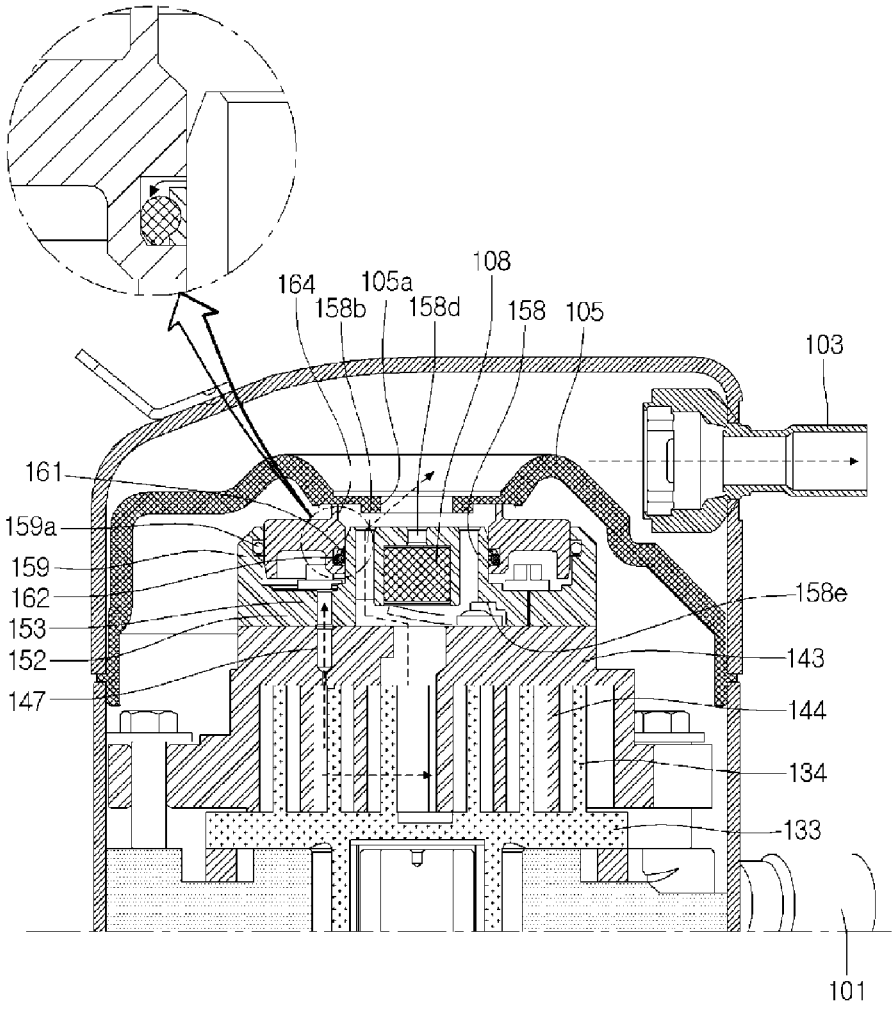
FIG. 14 is a cross-sectional view illustrating a flow of refrigerant when the scroll compressor operates according to an embodiment.
Figure 15:
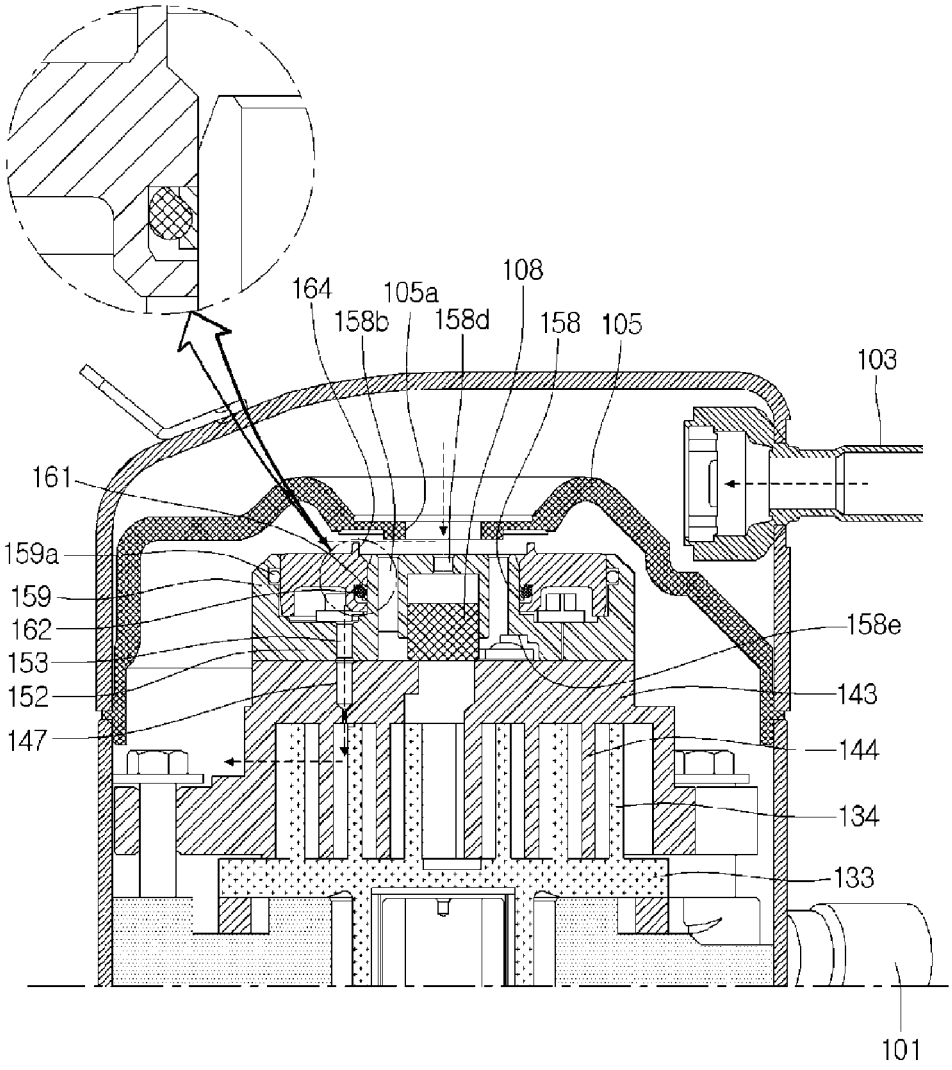
FIG. 15 is a cross-sectional view illustrating a flow of refrigerant when the scroll compressor stops according to an embodiment.

FIG. 14 is a cross-sectional view illustrating a flow of refrigerant when the scroll compressor operates according to an embodiment. FIG. 15 is a cross-sectional view illustrating a flow of refrigerant when the scroll compressor stops according to an embodiment.

Referring to FIGS. 14 and 15, when the scroll compressor operates or stops, effects according to this embodiment, that is, a flow of the refrigerant will be described hereinbelow. Referring to FIG. 14, in a case in which the scroll compressor 100 operates, when power is applied to the stator 112, the rotational shaft 116 is rotated by the stator 112 and the rotor 114. As the rotational shaft 116 rotates, the orbiting scroll 130 coupled to the rotational shaft 116 may revolve with respect to the fixed scroll 140. As a result, the plurality of compression chambers formed between the fixed wrap 144 and the orbiting wrap 134 may move toward the discharge hole 145 to compress the refrigerant.

The fixed wrap 144 and the orbiting wrap 134 may be closely attached to each other in a radial direction, that is, a direction perpendicular to the rotational shaft 116 to form the plurality of compression chambers. The plurality of compression chambers may be sealed by the closely attached operations of the wraps 134 and 144 to prevent the refrigerant from radially leaking.

While the refrigerant is compressed, at least a portion of the refrigerant within the compression chamber having the intermediate pressure may be introduced into the back pressure chamber BP through the intermediate pressure discharge hole 147 of the fixed scroll 140 and the intermediate pressure suction hole 153 of the back pressure plate 150. Even though the orbiting wrap 134 of the orbiting scroll 130 is disposed directly below the intermediate pressure discharge hole 147 to contact the intermediate pressure discharge hole 147, as the intermediate pressure discharge hole 147 and the compression chamber communicate with each other by the discharge guide 139, the refrigerant may flow into the intermediate pressure discharge hole 147. Also, as the intermediate pressure discharge hole 147 and the back pressure chamber BP communicate with each other, the refrigerant flowing through the intermediate pressure discharge hole 147 may be easily introduced into the back pressure chamber BP.

Thus, the back pressure chamber BP may have the intermediate pressure that corresponds between the suction pressure and the discharge pressure. Also, as the back pressure chamber has the intermediate pressure, a downward force may be applied to the back pressure plate 150, and an upward force may be applied to the floating plate 160.

As the back pressure plate 150 is coupled to the fixed scroll 140, the intermediate pressure of the back pressure chamber BP may have an influence on the fixed scroll 140. However, as the fixed wrap 143 of the fixed scroll 140 is in contact with the orbiting head plate 133 of the orbiting scroll 130, the floating plate 160 may move upward. As the floating plate 160 moves upward, the rib 164 of the floating plate 160 may move upward until the rib 164 contacts the bottom surface of the discharge cover 105.

While the floating plate 160 ascends, the second sealing members 161 and 162 may move downward within the groove 160*a* of the floating plate 160, and thus, the seal 161 may be deformed to allow the inner circumferential surface and the bottom surface of the groove 160*a* to be closely attached to each other.

Also, the pressure of the back pressure chamber BP may compress the fixed scroll 140 toward the orbiting scroll 130 to prevent the refrigerant from leaking between the orbiting scroll 130 and the fixed scroll 140. The fixed wrap 144 and orbiting head plate 133 and the orbiting wrap 134 and the fixed head plate 143 may be closely attached to each other in an axial direction, that is, a direction parallel to the rotational shaft 116 to form the plurality of compression chambers. The plurality of compression chambers may be sealed by adhesion between the wraps 134 and 144 and the orbiting and fixed head plates 133 and 143 to prevent the refrigerant from leaking in the axis direction.

Also, the refrigerant of the compression chamber moving toward the discharge hole 145 may flow toward the intermediate discharge hole 158*b* of the back pressure plate 150 through the discharge hole 145, and then, may be discharged to the outside of the discharge port 103 via the discharge hole 105*a* of the discharge cover 105.

The discharge valve 108 may be in a state in which the discharge valve 108 is moved upward along the moving guide 158*c* by the refrigerant having the discharge pressure, which may be discharged from the discharge hole 145. Thus, the discharge hole 145 may be opened. That is, as the pressure of the discharge hole 145 is greater than the pressure of the discharge space D, the discharge valve 108 may move upward.

As described above, as the rib 164 contacts the bottom surface of the discharge cover 105 to block the passage between the floating plate 160 and the discharge cover 105, refrigerant passing through the intermediate discharge hole 158*b* may not flow toward the suction space S through the passage to pass through the discharge hole 105*a* of the discharge cover 105. Although not shown, while the refrigerant is compressed in the plurality of compression chambers, the compression chamber that communicates with the bypass hole(s) 149 may have the intermediate pressure. As the intermediate pressure is less than the discharge pressure, the bypass hole(s) 149 may be in a closed state.

However, if the suction pressure increases due to changes in operation conditions, the intermediate pressure, which is greater by about 1.5 times than the suction pressure, may be greater than the discharge pressure. In a case of the scroll compressor, as a compression ratio is fixed, the discharge pressure may be obtained by multiplying the suction pressure by the compression ratio. Thus, if the suction pressure exceeds an optimal range, the discharge pressure may excessively increase, causing overload. Thus, even before the refrigerant of the compression chamber having the intermediate pressure reaches the discharge hole 145, if the intermediate pressure is excessive, the refrigerant has to be previously discharged to solve the overload.

In this embodiment, if the intermediate pressure increases and greater than the discharge pressure, the valve body 124*c* may ascend to allow the bypass valve(s) 124 to open the bypass hole(s) 149. Also, the refrigerant within the compression chamber having the intermediate pressure chamber may flow into the discharge space D through the bypass hole(s) 149. The refrigerant discharged through the bypass hole(s) 149 may be mixed with the refrigerant discharged from the discharge hole 145 to flow into the discharge space D. Due to the above-described operation, the excessive increase of the pressure of the compression chamber having the intermediate pressure chamber may be prevented.

In the case of the scroll compressor, as a range of operation conditions of a system to be adopted for the compressor is preset or predetermined, ranges of the suction and discharge pressures may be predetermined. Also, a time point at which the compression chamber having the intermediate pressure is excessive may be predicted on the basis of the above-described values. Thus, the bypass hole(s) may be formed at a position or positions corresponding to the time point to solve the overload.

In this embodiment, as the back pressure chamber assembly 400 is separable, the bypass hole(s) 149 may be defined in a predetermined position of the fixed head plate 143 of the fixed scroll 140, and then, the bypass valve(s) 124 may be disposed to effectively prevent overload from occurring.

Next, referring to FIG. 15, when the scroll compressor 100 stops, the supply of power applied to the stator 112 may stop. Thus, rotation of the rotational shaft 116 and revolution of the orbiting scroll 130 may stop stopping a compression operation of the refrigerant. When the compression operation of the refrigerant is stopped, a force to closely attach the fixed wrap 114 to the orbiting wrap 134, that is, a force to closely attach the fixed wrap 114 to the orbiting wrap 134 in the radial direction may be relieved or released. Thus, the sealed compression chamber formed by the fixed wrap 144 and the orbiting wrap 134 may vanish.

In detail, the discharge hole-side refrigerant having a relatively high pressure and the refrigerant within the compression chamber may flow toward the suction space S. A pressure of the wrap space formed by the fixed wrap 144 and the orbiting wrap 134 may converge to a predetermined pressure (equilibrium pressure). Also, as the pressure of the discharge space D temporarily increases, the discharge valve 108 may move downward to block the discharge hole 145. Thus, it may prevent the refrigerant of the discharge space D from flowing backward to the wrap space through the intermediate discharge hole 158*b* and the discharge hole 145 and reversing the fixed scroll 140.

As the scroll compressor 100 is stopped, the orbiting wrap 134 may be stopped at a predetermined position. Even though the orbiting wrap 134 is disposed at a position at which the intermediate pressure discharge hole 147 is opened (see FIG. 12A), as well as, the orbiting wrap 134 is disposed at a position at which the intermediate pressure discharge hole 147 is closed (see FIG. 12B), refrigerant of the back pressure chamber BP may be bypassed to the wrap space through the discharge guide 139.

That is, the refrigerant of the back pressure chamber BP may be introduced into the wrap space through the intermediate pressure suction hole 153 and the intermediate pressure discharge hole 147 to flow into the suction space S. Also, the back pressure chamber BP may be maintained at the equilibrium pressure by the flow of the refrigerant.

As the back pressure chamber BP is maintained at the equilibrium pressure, the floating plate 160 may move downward, and thus, the rib 164 may be spaced apart from the bottom surface of the discharge cover 105. While the floating plate 160 moves downward, the second sealing members 161 and 162 may move upward within the groove 160*a* of the floating plate 160, and thus, the seal 161 may be deformed to allow the inner circumferential surface and the top surface of the groove 160*a* to be closely attached to each other.

Thus, the passage between the floating plate 160 and the discharge cover 105 may be opened. As a result, the refrigerant of the discharge cover 105 or the discharge space D may flow toward the suction space S through the passage. The pressure of the discharge cover 105 or the discharge space D may be maintained at the equilibrium pressure by the flow of the refrigerant.

As described above, as the refrigerant of the back pressure chamber BP is introduced into the wrap space through the discharge guide 139 of the orbiting wrap 134, the back pressure chamber BP may be maintained at the equilibrium pressure. Also, the rib 164 may be spaced apart from the discharge cover 105 to open the passage of the refrigerant. As a result, as the pressure of the discharge cover 105 or the discharge space D is maintained at the equilibrium pressure, the scroll compressor 100 may quickly re-operate when the scroll compressor 100 is re-operated.

If the refrigerant of the back pressure chamber BP is not introduced into the wrap space to allow the back pressure chamber BP to be maintained to the intermediate pressure, and also, the rib 164 is maintained in contact with the discharge cover 105, and thus, the pressure of the discharge cover 105 and the discharge space D is not maintained at the equilibrium pressure, the fixed scroll 140 and the orbiting scroll 130 may be closely attached to each other at an excessive pressure. As a result, it may be difficult to quickly drive the scroll compressor 100 again. However, this embodiment may solve the above-described limitation.

Also, even though the refrigerant of the back pressure chamber BP smoothly flows into the wrap space, if the rib 164 of the floating plate 160 is not quickly spaced apart from the discharge cover 105, it may be difficult to quickly re-operate the scroll compressor 100. In the case of this embodiment, as the seal cover 162 of the second sealing member contacts the first wall 158, the floating plate 160 may quickly move downward, and thus, the rib 164 of the floating plate 160 may be quickly spaced apart from the discharge cover 105.

Also, a check valve (not shown) may be disposed in the discharge port 103. Thus, when operation of the scroll compressor 100 stops, the check valve may be closed to prevent the refrigerant outside of the scroll compressor 100 from being introduced into the casing 110 through the discharge port 103.

Figure 16:
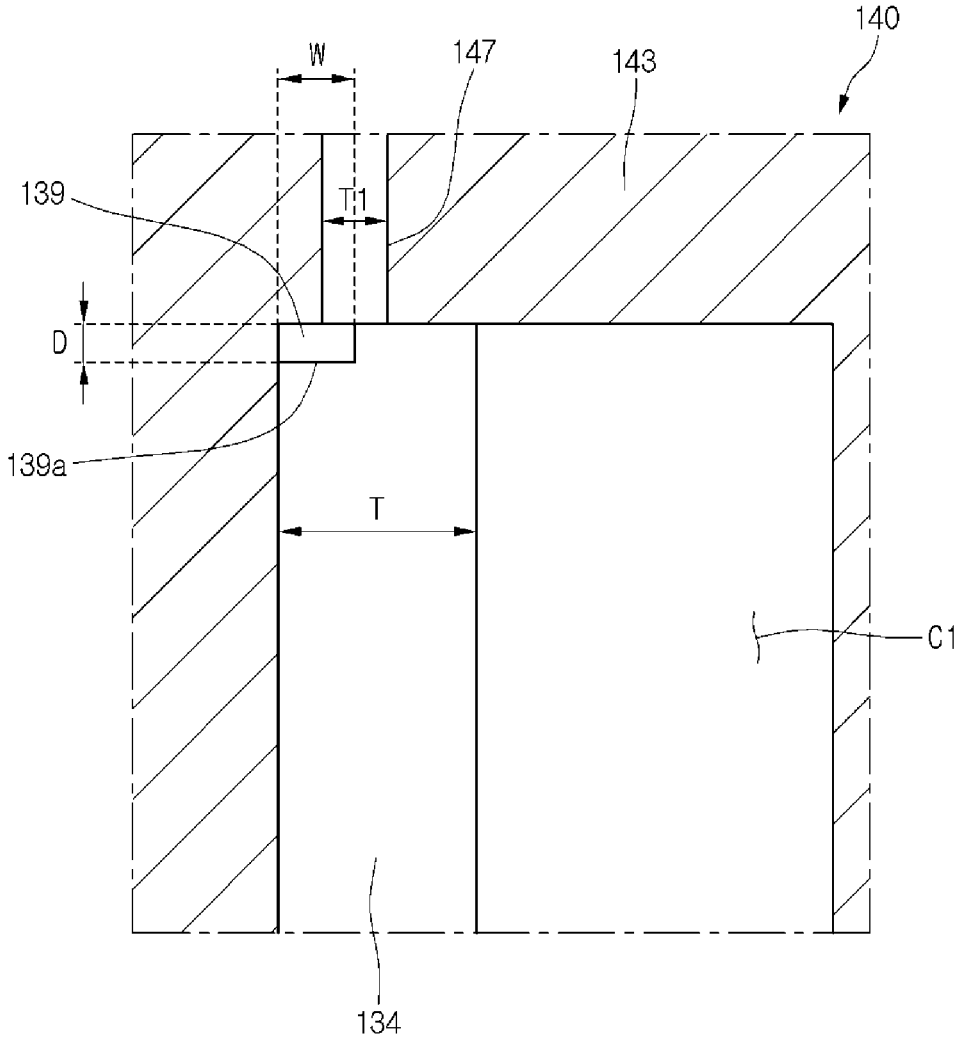
FIG. 16 is a cross-sectional view illustrating the discharge guide of the orbiting scroll according to an embodiment.
Figure 17A:
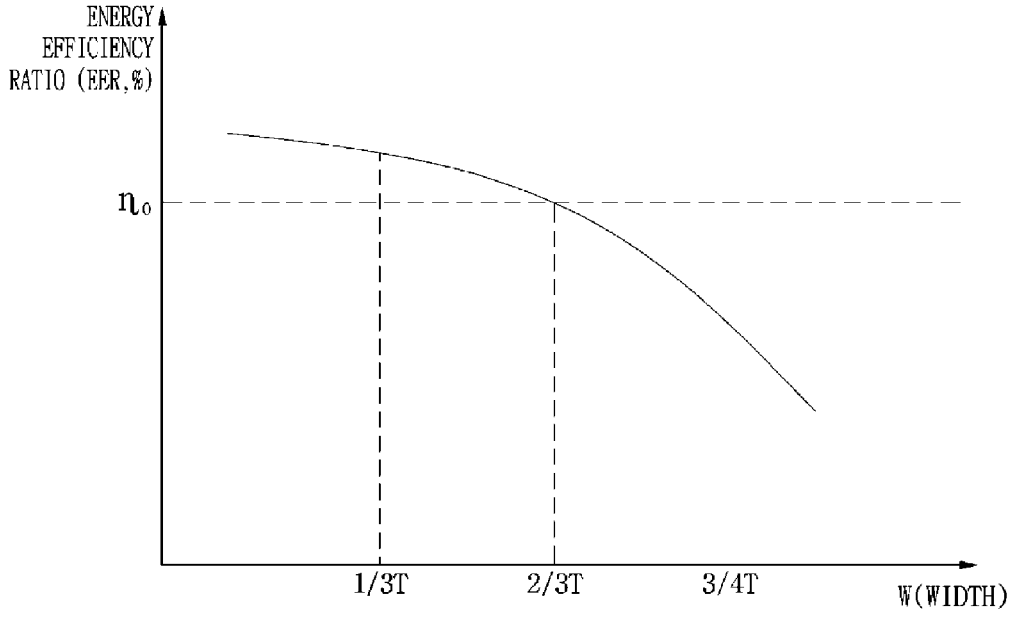
FIGS. 17A and 17B are graphs illustrating a variation in efficiency of the scroll compressor according to a size of the discharge guide.
Figure 17B:
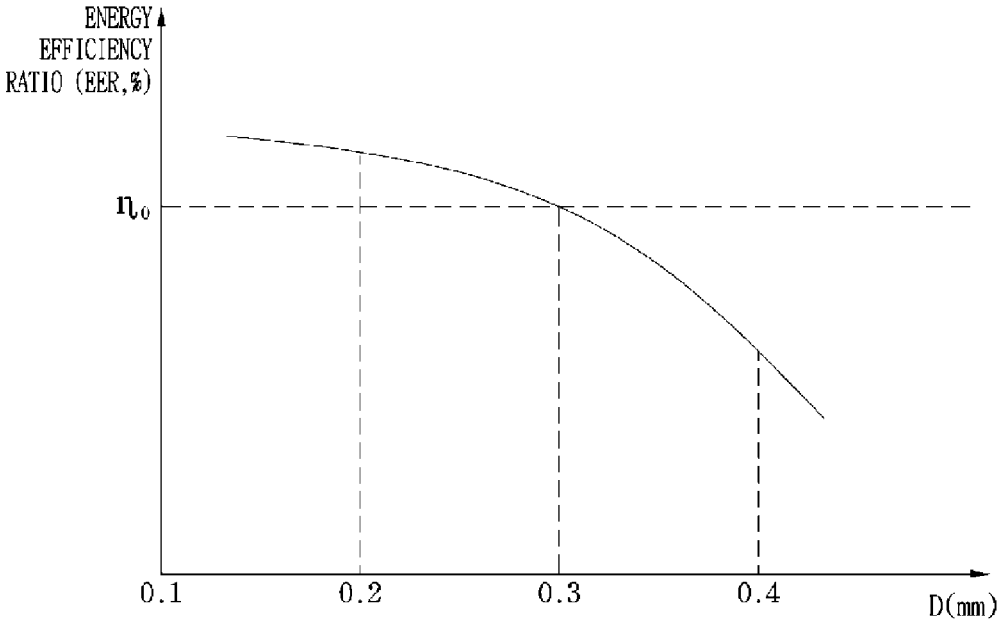

FIG. 16 is a cross-sectional view illustrating a discharge guide of the orbiting scroll according to an embodiment. FIGS. 17A and 17B are graphs illustrating a variation in efficiency of the scroll compressor according to a size of the discharge guide.

Referring to FIG. 16, in the orbiting wrap 134, the discharge guide 139 to open the intermediate pressure discharge hole 147 and guide the refrigerant so that the refrigerant is discharged from the intermediate pressure discharge hole 147 to a wrap space C1 may be defined to have a preset or predetermined width W and depth D. The width W may refer to as a length in a radius direction of the discharge guide 139, and the depth D may refer to a distance from an end of the intermediate pressure discharge hole 147 to a recessed surface 139*a* of the discharge guide 139.

The wrap space C1 may refer to a space between the orbiting wrap 134 and the fixed wrap 144 in a state in which the compression chamber formed by closely attaching the orbiting wrap 134 to the fixed wrap 144 vanishes after the scroll compressor 100 stops. Also, the orbiting wrap 134 may have a thickness T greater than a size or thickness T1 of the intermediate pressure discharge hole 147. The size or thickness T1 of the intermediate pressure discharge hole 147 may be a diameter when the intermediate pressure discharge hole 147 has a circular cross-section. When the intermediate pressure discharge hole 147 has an oval or polygonal shape, the size or thickness T1 of the intermediate pressure discharge hole 147 may be a largest width defined in a horizontal (radial) direction.

The discharge guide 139 may have the recessed surface 139*a* formed by being recessed to have the width W and depth D. A horizontal length of the recessed surface 139*a* may correspond to the width W, and a vertical length of the recessed surface 139*a* may correspond to the depth D.

Although the recessed surface 139*a* is bent in a horizontal or vertical direction in FIG. 16, embodiments are not limited thereto. For example, the recessed surface 139*a* may include a curved portion or have a straight-line shape without being bent.

If the discharge guide 139 has a too large width W or depth D, the refrigerant may leak from the compression chamber having a relatively high pressure to the compression chamber having a relatively low pressure among the plurality of compression chambers when the scroll compressor 100 operates, and thus, the scroll compressor 100 may be deteriorated in operation efficiency. Thus, this embodiment proposes a dimension with respect to the width W or depth D of the discharge guide 139 to allow the refrigerant to smoothly flow from the back pressure chamber BP to the wrap space C1 without deteriorating the operation efficiency of the compressor. FIGS. 15A-15B illustrates a graph obtained by repetitive experiments.

Referring to FIG. 17A, a horizontal axis of the graph represents a width W of the discharge guide 139, and a vertical axis represents an energy efficiency ratio (EER) of the scroll compressor. The discharge guide 139 may have a depth D corresponding to a preset or predetermined value (constant value).

In detail, the more the width W of the discharge guide 139 increases, the more a leaking amount of refrigerant while the refrigerant is compressed, that is, a refrigerant leaking amount in an axial direction increases. Thus, the EER of the scroll compressor may be reduced.

Also, to maintain the EER of the scroll compressor 100 to a value greater than a required efficiency ratio $\eta o$, the discharge guide 139 may have a width W less than about 2T/3. When the width W of the discharge guide 139 is less than about 2T/3, for example, is 3T/4, it may be seen that the EER of the scroll compressor 100 is reduced by about 30% or more in comparison with the required efficiency ratio ηo.

Next, referring to FIG. 16B, a horizontal axis of the graph represents a depth D of the discharge guide 139, and a vertical axis represents the energy efficiency ratio (EER) of the scroll compressor. The discharge guide 139 may have a width W corresponding to a preset or predetermined value (constant value).

In detail, the more the depth D of the discharge guide 139 increases, the more a leaking amount of refrigerant while the refrigerant is compressed, that is, a refrigerant leaking amount in a radial direction increases. Thus, the EER of the scroll compressor 100 may be reduced.

Also, to maintain the EER of the scroll compressor 100 to a value greater than a required efficiency ratio ηo, the discharge guide 139 may have a depth D less than about 0.3 mm. When the depth D of the discharge guide 139 is less than about 0.3 mm, for example, is about 0.4 mm, it may be seen that the EER of the scroll compressor is reduced by about 30% or more in comparison with the required efficiency ratio ηo.

In summary, the discharge guide 139 may have a depth D of about 0.3 mm or less. Also, the discharge guide 139 may have a width W less by about ⅔ times than the thickness T of the orbiting wrap 134.

Figure 18:
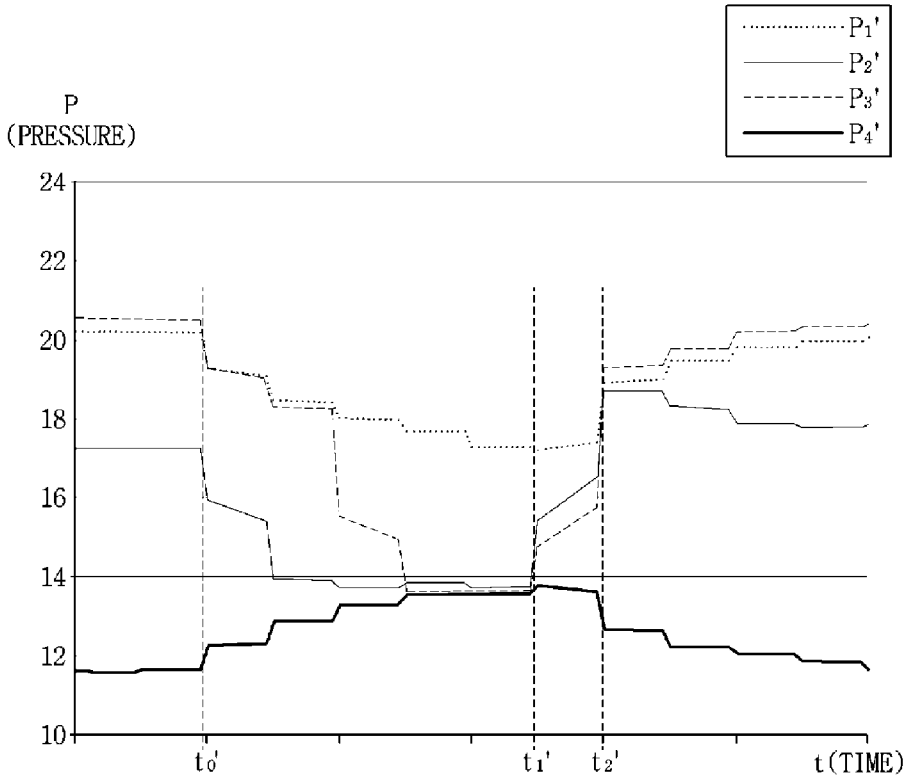
FIG. 18 is a graph illustrating a variation in inner pressure of the compressor when the scroll compressor stops and then re-operates according to an embodiment.

FIG. 18 is a graph illustrating a variation in inner pressure of the scroll compressor when the scroll compressor stops and then re-operates according to an embodiment. Referring to FIG. 18, when the scroll compressor 100 is stopped at a time $t_0'$, each of $P_1'$ (a pressure of the refrigerant discharged from the scroll compressor), $P_2'$ (an intermediate pressure of the back pressure chamber), $P_3'$ (a pressure of the discharge cover-side refrigerant), and $P_4'$ (a pressure of the suction-side refrigerant) may gradually converge to an equilibrium pressure.

Also, when a power is applied to the stator 112 at a time $t_1'$ to allow an operation of the scroll compressor to start, the scroll compressor may re-operate at a time $t_2'$ after a short time Δt elapses. As a result, a difference in pressure for each position within the scroll compressor may occur. That is, actual compression of the refrigerant may be quickly performed.

Figure 19:
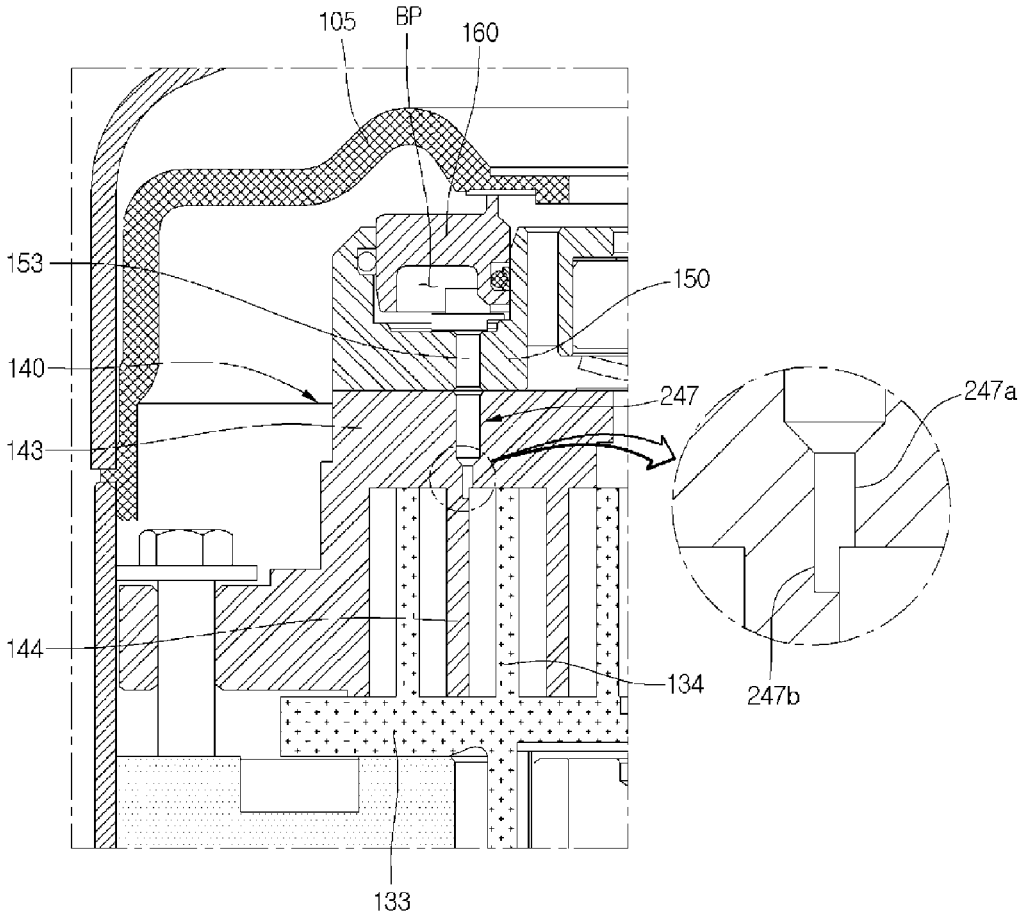
FIG. 19 is a partial cross-sectional view of a scroll compressor according to another embodiment.

FIG. 19 is a partial cross-sectional view of a scroll compressor according to another embodiment. Referring to FIG. 19, scroll compressor 100 according to this embodiment may include an intermediate pressure discharge hole 247 to define a discharge guide in fixed scroll 140 to guide a flow of a refrigerant into a compression chamber. In detail, the intermediate pressure discharge hole 247 may include a first guide 247*a* defined in fixed head plate 143 of the fixed scroll 140, and a second guide 247*b* defined in fixed wrap 144 of the fixed scroll 140. Each of the first and second guides 247*a* and 247*b* may form at least a portion of the intermediate pressure discharge hole 247.

Unlike that the intermediate discharge hole 147 according to the previous embodiment which is defined in the fixed head plate 143 of the fixed scroll 140, the intermediate pressure discharge hole 247 according to this embodiment may extend from the fixed head plate 143 of the fixed scroll 140 into the fixed wrap 144. That is, the intermediate pressure discharge hole 247 may be defined in the fixed wrap 144.

As a result, as the intermediate pressure hole 247 may function as a "discharge guide" and may be defined in the fixed head plate 143 and extend into the fixed wrap 144, that is, as an opened portion of the intermediate pressure discharge hole 247 extends in an "axial direction" parallel to rotational shaft 116 and a "radial direction" perpendicular to the axial direction, the intermediate pressure discharge hole 247 may easily communicate with the compression chamber.

More particularly, in a state in which the scroll compressor 100 stops, adhesion between the fixed scroll 140 and the orbiting scroll 130 in the radial direction may be weakened to form a wrap space between the orbiting wrap 134 and the fixed wrap 144. Thus, the refrigerant may be easily discharged from the intermediate pressure discharge hole 247.

In summary, as the discharge guide according to this embodiment is defined in the intermediate pressure discharge hole 247, when the scroll compressor 100 stops, back pressure chamber BP may communicate with the wrap space regardless of a position of the orbiting wrap 134. Thus, the scroll compressor may quickly re-operate.

Further, while the scroll compressor 100 operates to compress the refrigerant, the intermediate pressure discharge hole 247 may communicate with the compression chamber through the first and second guides 247*a* and 247*b* regardless of a position of the orbiting wrap 134. Thus, the refrigerant of the compression chamber may be easily bypassed to the back pressure chamber BP via the intermediate pressure discharge hole 247.

Embodiments disclosed herein provide a scroll compressor.

Embodiments disclosed herein provide a scroll compressor that may include a casing including a rotational shaft; a discharge cover fixed inside of the casing to partition the inside of the casing into a suction space and a discharge space; a first scroll revolving by rotation of the rotational shaft; a second scroll that defines a plurality of compression chambers together with the first scroll, the second scroll having an intermediate pressure discharge hole that communicates with a compression chamber having an intermediate pressure of the plurality of compression chambers; a back pressure plate that defines a back pressure chamber that accommodates a refrigerant discharged from the intermediate pressure discharge hole; a floating plate movably disposed on a side of the back pressure plate to define the back pressure chamber together with the back pressure plate; and a sealing member disposed on one of first and second surfaces to prevent the refrigerant from flowing between the first surface, which may be a sliding surface of the floating plate, and the second surface, which may face the first surface, of the back pressure plate. The sealing member may include a seal cover that contacts the other one of the first and second surfaces, and a seal, a portion of which may be accommodated in the seal cover. The seal cover may have a friction coefficient less than a friction coefficient of the seal.

Embodiments disclose herein further provide a scroll compressor that may include a casing including a rotational shaft; a discharge cover fixed inside of the casing to partition the inside of the casing into a suction space and a discharge space; a first scroll revolving by rotation of the rotational shaft; a second scroll that defines a plurality of compression chambers together with the first scroll, the second scroll having an intermediate pressure discharge hole that communicates with a compression chamber having an intermediate pressure of the plurality of compression chambers; a back pressure plate that defines a back pressure chamber that accommodates a refrigerant discharged from the intermediate pressure discharge hole; a floating plate movably disposed on a side of the back pressure plate to define the back pressure chamber together with the back pressure plate; and a sealing member disposed on at least one of the floating plate or the back pressure plate to prevent the refrigerant within the discharge space from being introduced into the back pressure chamber or prevent the refrigerant within the back pressure chamber from being introduced into the discharge space. The sealing member may include a seal cover that contacts the back pressure plate or the floating plate while the floating plate is slid, and a seal in which a portion of the seal cover may be accommodated. The seal cover may have a friction coefficient less than a friction coefficient of the seal.

The details of one or more embodiments are set forth in the accompanying drawings and the description. Other features will be apparent from the description and drawings, and from the claims.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing comprising a rotational shaft;

a discharge cover fixed inside of the casing to partition the inside of the casing into a suction space and a discharge space;

a first scroll that is revolved by rotation of the rotational shaft;

a second scroll that defines a plurality of compression chambers together with the first scroll, the second scroll having an intermediate pressure discharge hole that communicates with a compression chamber having an Intermediate pressure of the plurality of compression chambers;

a back pressure plate that defines a back pressure chamber that accommodates a refrigerant discharged from the intermediate pressure discharge hole;

a floating plate movably disposed on or at a side of the back pressure plate to define the back pressure chamber together with the back pressure plate; and a sealing member disposed on one of first and second surfaces to prevent the refrigerant from flowing between the first surface, which is a sliding surface of the floating plate, and the second surface, which faces the first surface, of the back pressure plate, wherein the sealing member comprises a seal cover that contacts at least the other one of the first and second surfaces, and a seal, a portion of which is accommodated in the seal cover, and wherein the seal cover has a friction coefficient less than a friction coefficient of the seal.

2. The scroll compressor according to claim 1, wherein the seal cover is formed of a poly tetra fluoro ethylene material.

3. The scroll compressor according to claim 2, wherein the seal cover comprises a filler containing at least one of glass fiber or mineral fiber, and graphite.

4. The scroll compressor according to claim 1, wherein the first and second surfaces are disposed between the discharge space and the back pressure chamber.

5. The scroll compressor according to claim 1, wherein a groove in which the sealing member is accommodated, is defined in the first surface, and wherein the seal cover has a width less than a width of the sealing member.

6. The scroll compressor according to claim 1, wherein a seal accommodation groove, in which a portion of the seal is accommodated, is defined in the seal cover, and wherein the seal accommodation groove has a cross-sectional area less than a half of a cross-sectional area of the seal.

7. The scroll compressor according to claim 1, wherein the back pressure plate comprises a first wall that passes through the floating plate, wherein the first surface is an inner circumferential surface of the floating plate, and the second surface is an outer circumferential surface of the first wall, wherein the sealing member is disposed on the first surface, and wherein an inner circumferential surface of the seal cover has a diameter less than a diameter of the outer circumferential surface of the first wall.

8. The scroll compressor according to claim 1, wherein the back pressure plate comprises a first wall that passes through the floating plate, wherein the first surface is an inner circumferential surface of the floating plate, and the second surface is an outer circumferential surface of the first wall, wherein the sealing member is disposed on the second surface, and wherein an outer circumferential surface of the seal cover has a diameter greater than a diameter of the inner circumferential surface of the floating plate.

9. The scroll compressor according to claim 1, wherein the seal cover has a friction coefficient less than about 1/10 of a friction coefficient of the seal.

10. The scroll compressor according to claim 1, wherein a discharge guide that guides discharge of the refrigerant within the back pressure chamber is disposed on at least one of the first sera or the second scroll.

11. The scroll compressor according to claim 10, wherein the first scroll comprises a first head plate coupled to the rotational shaft and a first wrap that extends from the first head plate in one direction, and wherein the discharge guide comprises a recess funned by recessing at least a portion of the first wrap.

12. The scroll compressor according claim 1, wherein the first scroll comprises an orbiting scroll and the second scroll comprises a fixed scroll.

13. A scroll compressor, comprising:

a casing comprising a rotational shaft;

a discharge cover fixed inside of the casing to partition the inside of the casing into a suction space and a discharge space;

a first scroll that is revolved by rotation of the rotational shaft;

a second scroll that defines a plurality of compression chambers together with the first scroll, the second scroll having an intermediate pressure discharge hole that communicates with a compression chamber having an intermediate pressure of the plurality of compression chambers;

a back pressure plate that defines a back pressure chamber that accommodates a refrigerant discharged from the intermediate pressure discharge hole;

a floating plate movably disposed on or at a side of the back pressure plate to define the back pressure chamber together with the back pressure plate; and a sealing member disposed on at least one of the floating plate or the back pressure plate to prevent the refrigerant within the discharge space from being introduced into the back pressure chamber or prevent the refrigerant within the back pressure chamber from being introduced into the discharge space, wherein the sealing member comprises, a seal cover that contacts the back pressure plate or the floating plate while the floating plate slides, and a seal, in which a portion of the seal cover is accommodated, and wherein the seal cover has a friction coefficient less than a friction coefficient of the seal.

14. The scroll compressor according to claim 13, wherein a groove, in which the sealing member is accommodated, is defined in at least one of the floating plate or the back pressure plate, and wherein the seal contacts at least two surfaces in the groove while the floating plate slides.

15. The scroll compressor according to claim 14, wherein all of the seal and a portion of the seal cover are accommodated in the groove.

16. The scroll compressor according to claim 13, wherein a seal accommodation groove, in which a portion of the seal is accommodated, is defined in the seal cover, and wherein the seal accommodation groove has a cross-sectional area less than a half of a cross-sectional area of the seal.

17. The scroll compressor according to claim 13, wherein the seal cover has a friction coefficient less than about 1/10 of a friction coefficient of the seal.

18. The scroll compressor according to claim 13, wherein the seal cover has an elastic coefficient greater than an elastic coefficient of the seal.

19. The scroll compressor according to claim 13, wherein the seal cover is formed of a poly tetra fluoro ethylene material.

20. The scroll compressor according claim 13, wherein the first scroll comprises an orbiting scroll and the second scroll comprises a fixed scroll.

* * * * *